US008622472B2

(12) United States Patent
Rajaratnam

(10) Patent No.: US 8,622,472 B2
(45) Date of Patent: Jan. 7, 2014

(54) BACK SUPPORT ADJUSTMENT SYSTEM

(75) Inventor: Kumar Rajaratnam, Hawthorn (AU)

(73) Assignee: C-Pod Ergonomics Pty. Ltd., Mississauga (CA)

( * ) Notice: Subject to any disclaimer, the term of this patent is extended or adjusted under 35 U.S.C. 154(b) by 845 days.

(21) Appl. No.: 12/294,472

(22) PCT Filed: Mar. 27, 2006

(86) PCT No.: PCT/CA2006/000453

§ 371 (c)(1),
(2), (4) Date: Jun. 29, 2010

(87) PCT Pub. No.: WO2007/109872

PCT Pub. Date: Oct. 4, 2007

(65) Prior Publication Data

US 2010/0264708 A1 Oct. 21, 2010

(51) Int. Cl.
*A47C 7/14* (2006.01)
*A47C 7/02* (2006.01)

(52) U.S. Cl.
USPC ..... 297/284.2; 297/452.56

(58) Field of Classification Search
USPC ..... 297/452.18, 452.63, 452.64, 284.2, 297/452.56, 284.3
See application file for complete search history.

(56) References Cited

U.S. PATENT DOCUMENTS

| | | | | | |
|---|---|---|---|---|---|
| 2,182,253 | A | * | 12/1939 | Farrell | 297/230.11 |
| 4,462,635 | A | * | 7/1984 | Lance | 297/284.3 |
| 4,580,840 | A | * | 4/1986 | Cunningham et al. | 297/452.18 |
| 4,858,992 | A | * | 8/1989 | LaSota | 297/284.2 |
| 5,213,395 | A | | 5/1993 | Korteweg et al. | |
| 5,316,371 | A | * | 5/1994 | Bishai | 297/339 |
| 5,403,067 | A | | 4/1995 | Rajaratnam | |
| 5,547,251 | A | | 8/1996 | Axelson | |
| 5,797,652 | A | | 8/1998 | Darbyshire | |
| 5,860,700 | A | * | 1/1999 | Lance | 297/284.8 |
| 5,867,852 | A | | 2/1999 | Knight | |
| 5,957,532 | A | * | 9/1999 | Watkins | 297/284.2 |
| 6,536,791 | B1 | | 3/2003 | Adams | |
| 6,971,717 | B1 | | 12/2005 | Rhodes | |
| 7,128,372 | B2 | * | 10/2006 | Farquhar et al. | 297/284.4 |

* cited by examiner

*Primary Examiner* — Milton Nelson, Jr.
(74) *Attorney, Agent, or Firm* — Lorelei G. Graham

(57) ABSTRACT

A back support adjustment system including a flexible suspension system having an adjustable and interchangeable flexing means positioned in between a frame and a support member. The back support adjustment system further includes an adjustable back support system having a housing integral with a back support surface and a tension assembly movable within the housing. Both the tension assembly and the adjustable back support system are adapted to engage the frame so that the movable tension assembly adjusts the tension of the adjustable back support system and the adjustable flexing means controls movement of the flexible suspension system.

59 Claims, 23 Drawing Sheets

BACK SUPPORT ADJUSTMENT SYSTEM

FIELD OF THE INVENTION

This invention relates in general to a support mechanism found in seating and more particularly to a back support adjustment system.

BACKGROUND OF THE INVENTION

Back support mechanisms for ergonomic chairs have attempted to provide sufficient support to the user's back, while providing improved functioning from other adjustment components on the chair. Typically ergonomic chairs are configured to allow for tilting of the seat and back support or backrest as a unit, or tilting of the backrest relative to the seat. However to be able to provide improved back support to a user, the chair should be able to adjust to the overall body posture and relative positioning of body parts so as to ensure comfort and minimize fatigue. The ability for the chair to adjust to the user's requirements is increasingly important, especially in the office environment since the user's tasks can vary and the work intensity of each given task can also vary. As such, the optimal position of the user's body in the chair is critical so as to ensure comfort and minimize fatigue.

Furthermore many ergonomic chairs utilize a backrest having a conventional configuration and material. Typically this backrest includes some form of frame having single or multi-density foam padding that is then covered with cloth, leather or the like. As such the backrest deforms to the user's back posture and does not provide the required support. Furthermore many back supports can not be personalized or self-adjusting to accommodate the various positions the user requires when involved in a work task.

Thus a back support adjustment system which allows the user to self-adjust the back support on an ergonomic chair to a desired position and to allow the back support to move with the user so as to provide constant support to the user's back is desirable.

SUMMARY OF THE INVENTION

An object of one aspect of the present invention is to provide an improved back support adjustment system that can be used in a seating environment such as a chair.

In accordance with one aspect of the present invention there is provided a back support adjustment system including a frame and an adjustable back support system having a back support surface and a moveable tension assembly that is integral within the back support surface. Both the back support surface and the movable tension assembly are adapted to engage the frame so that the movable tension assembly adjusts the tension across the back support surface.

In accordance with another aspect of the present invention there is provided a back support adjustment system having a frame and an adjustable back support system that has a housing integral with a back support surface and a tension assembly movable within the housing. Both the tension assembly and the adjustable back support system are adapted to engage the frame so that the movable tension assembly adjusts the tension of the adjustable back support system through the housing and therefore across the back support surface.

In accordance with another aspect of the present invention there is provided a back support adjustment system including a flexible suspension system having an adjustable and interchangeable flexing means positioned in between a frame and a support member. The back support adjustment system further includes an adjustable back support system having a back support surface and a moveable tension assembly integral within the back support surface. Both the back support surface and the movable tension assembly are adapted to engage the frame so that the movable tension assembly adjusts the tension across the back support surface and the adjustable flexing means controls movement of the flexible suspension system.

In accordance with another aspect of the present invention there is provided a back support adjustment system including a flexible suspension system having an adjustable and interchangeable flexing means positioned in between a frame and a support member. The back support adjustment system further includes an adjustable back support system having a housing integral with a back support surface and a tension assembly movable within the housing. Both the tension assembly and the adjustable back support system are adapted to engage the frame so that the movable tension assembly adjusts the tension of the adjustable back support system and the adjustable flexing means controls movement of the flexible suspension system.

In accordance with another aspect of the present invention there is provided a back support adjustment system including a flexible suspension system having an adjustable and interchangeable flexing means positioned in between a frame and a support member wherein the adjustable flexing means controls movement of the flexible suspension system. The back support adjustment system further includes a back support surface adapted to engage the frame wherein the back support surface has a front side and a back side. Finally the back support adjustment system includes an adjustable back support system having an adjustable tension assembly mounted to the frame and adapted to engage the back side of the back support surface when the front side of the back support surface is engaged.

In accordance with another aspect of the present invention there is provided a back support adjustment system including a frame and a back support surface adapted to engage the frame wherein the back support surface having a front side and a back side. The back support adjustment system further includes an adjustable back support system having an adjustable tension assembly mounted to the frame and adapted to engage the back side of the back support surface when the front side of the back support surface is engaged.

In accordance with another aspect of the present invention there is provided a back support adjustment system including a frame having a top portion and a bottom portion, a support member, and a first adjustable and interchangeable flexing means positioned in between the frame and the support member at the top portion of the frame thereby defining a single pivot point. At least a second adjustable and interchangeable flexing means may be positioned in between the frame and the support member at the bottom portion of the frame thereby defining at least single positioning point.

In accordance with another aspect of the present invention there is provided a removable head support system for seating having a height adjustment means and an angle adjustment means so that the height adjustment means and the angle adjustment means are controlled by a releasable clamping means, which is engaged when moving the height adjustment means up and down, and engaged when moving the angle adjustment means.

Advantages of the present invention are: the back adjustment system can be used in office seating, ergonomic seating, domestic seating, healthcare seating, and automobile seating; inserts for different types of seating such as lounges; allows for self-adjustment of the support provided by the back adjustment system, allows for dynamic movement of the frame to match the movement of the user thereby providing improved support during tasks; and a removable head support system.

BRIEF DESCRIPTION OF THE DRAWINGS

A detailed description of the preferred embodiments is provided herein below by way of example only and with reference to the following drawings in which.

Figure 1:
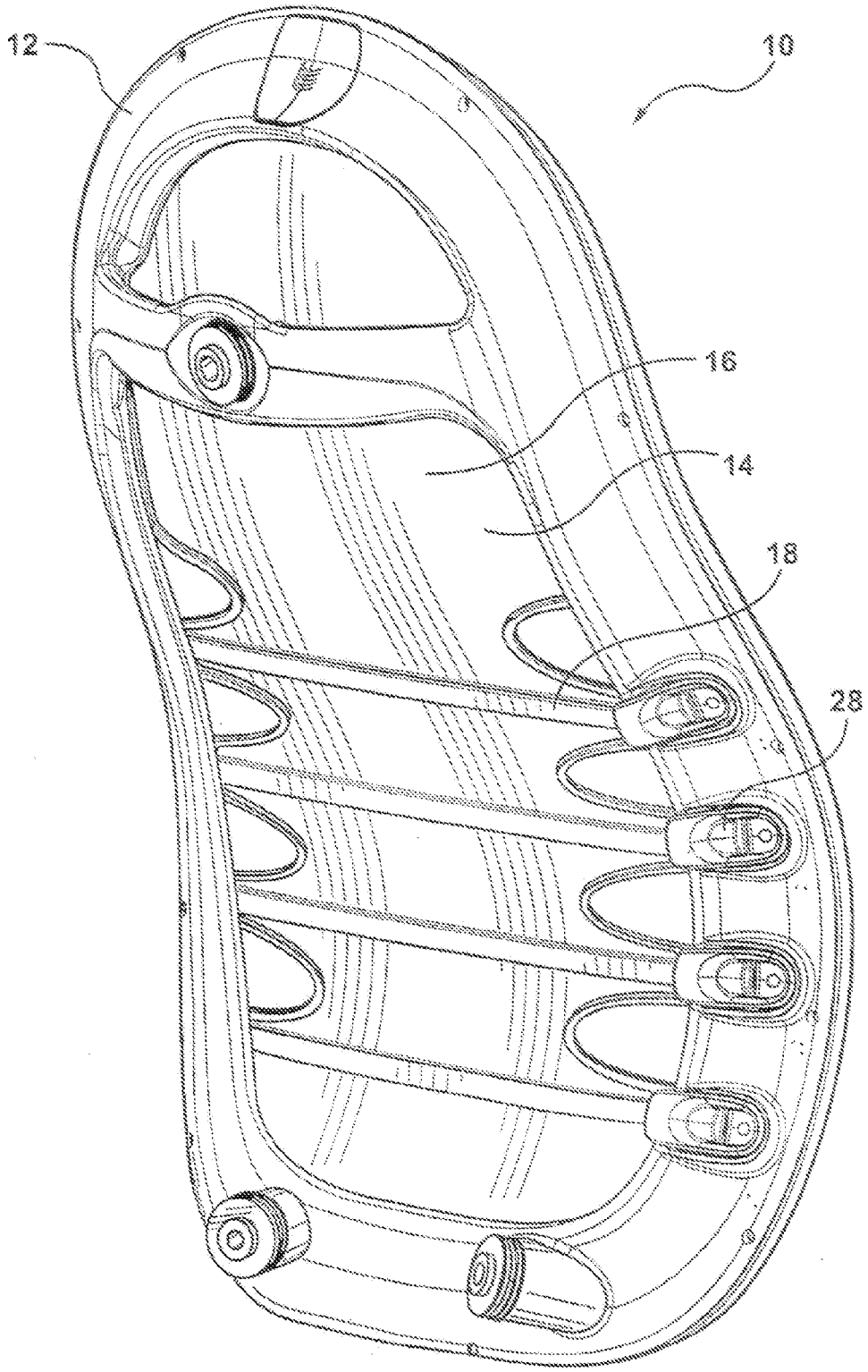
FIG. 1 in a perspective view, illustrates a back support adjustment system for a chair in accordance with a preferred embodiment of the present invention.
Figure 2:
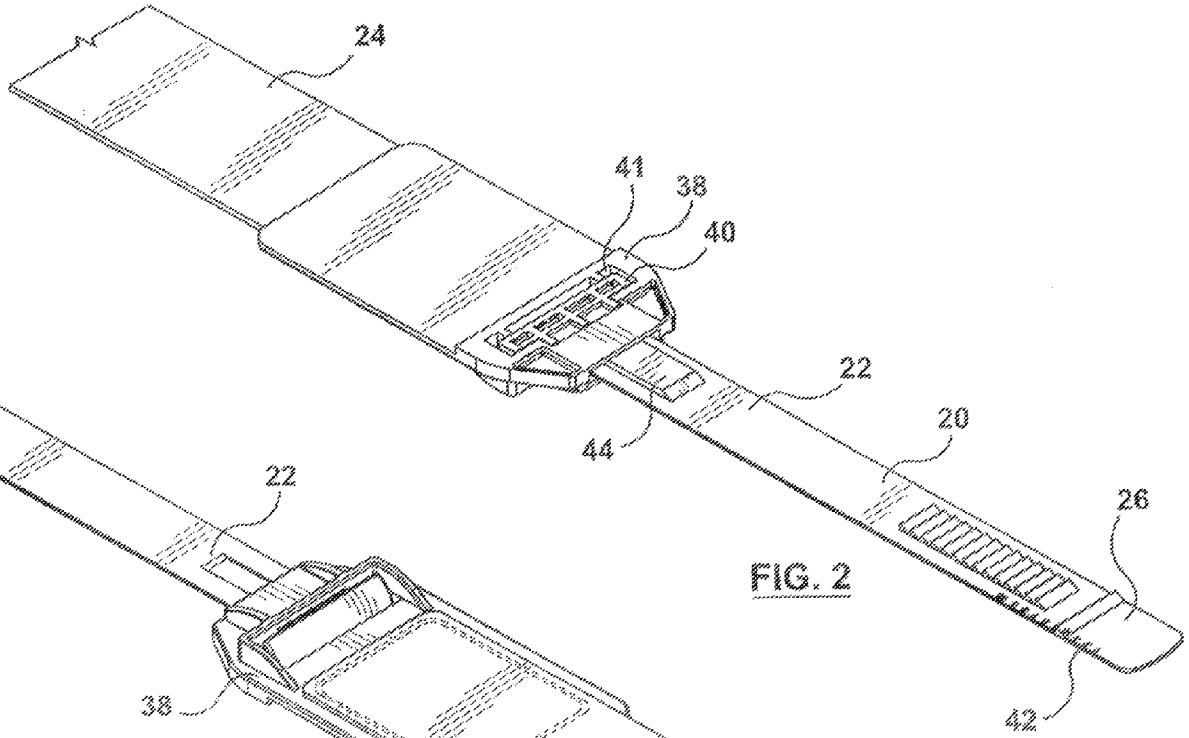
FIG. 2 in a top perspective view, illustrates the tension assembly of the back support adjustment system of FIG. 1.
Figure 3:
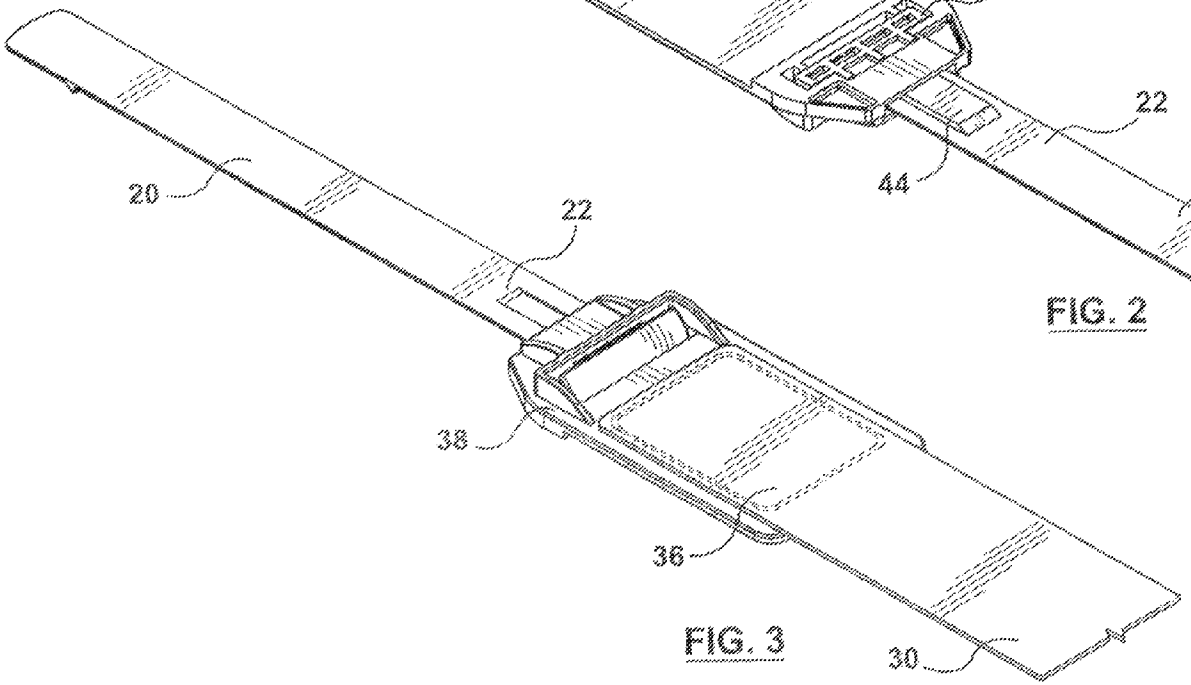
FIG. 3 in a bottom perspective view, illustrates tension assembly of FIG. 2.
Figure 4:
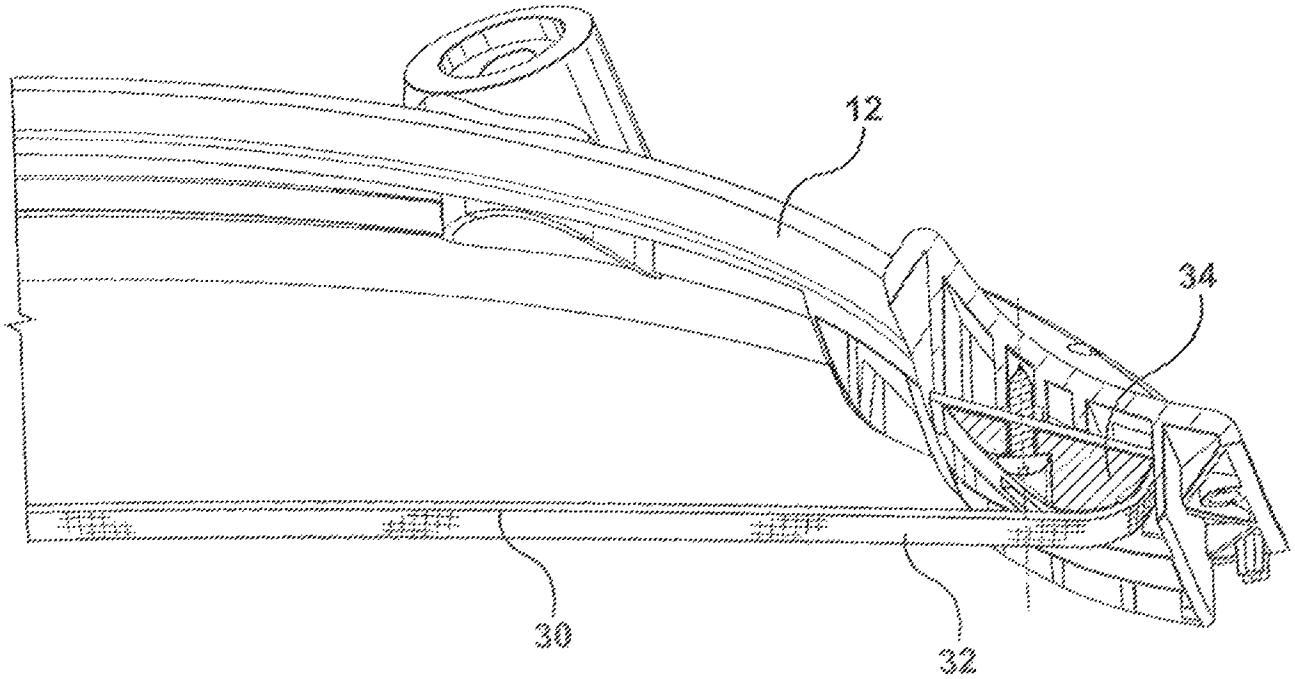
FIG. 4 in a partial cross-sectional view illustrates the tension assembly engaging the frame.
Figure 5B:
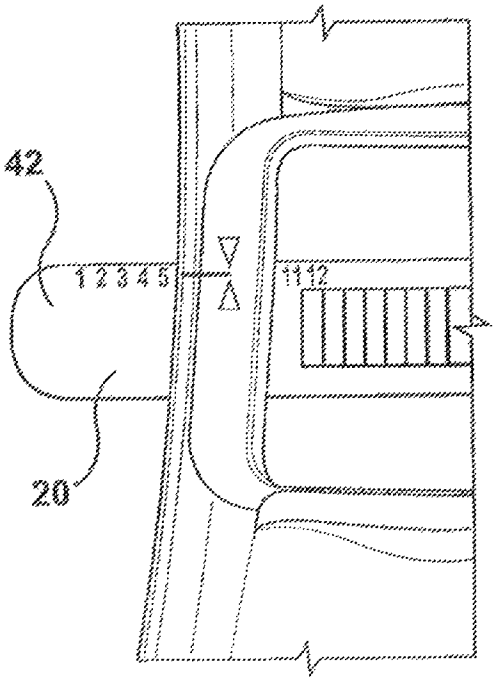
FIG. 5*b* in a back view illustrates the setting markings for tension adjustment in accordance with the back support adjustment system of FIG. 1.
Figure 5A:
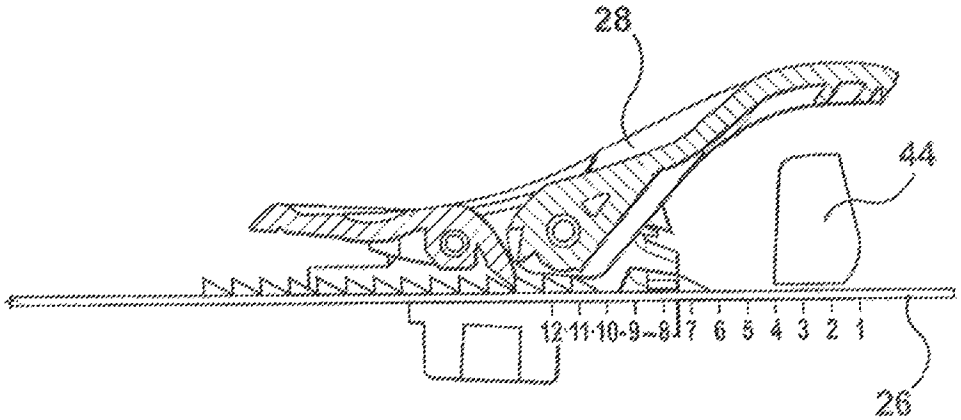
FIG. 5*a* in a partial cross-sectional view illustrates the releasable locking means of the embodiment of FIG. 1.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Referring to FIG. 1, there is illustrated in a perspective view, a back support adjustment system 10 for a chair in accordance with a preferred embodiment of the present invention. In the first embodiment of the present invention the back support adjustment system 10 includes a frame 12 and an adjustable back support system 14 having a back support surface 16 and a moveable tension assembly 18 that is integral within the back support surface 16. Both the back support surface 16 and the movable tension assembly 18 are adapted to engage the frame 12 so that the movable tension assembly 18 adjusts the tension across the back support surface 16.

Referring to FIGS. 2 to 5*b*, the movable tension assembly 18 further comprises a series of securing members 20, each having a first end 22 adapted to engage a tensioning means 24, and a second end 26 adapted to engage a releasable locking means 28 mounted in the frame 12. The tensioning means 24 is a series of tensioning members 30, each having a first end 32 adapted to engage a fixing buckle 34 mounted in the frame 12, and a second end 36 having an anchor member 38 adapted to engage the first end 22 of the securing member 20. The anchor member 38 may be secured to the second end 36 of the tensioning member 30 by stitching, glue, screws or rivets or a combination of same. The anchor member 38 further includes a slot 41 that allows for the convenient installation and removal of the first end 22 of the securing member 20. More specifically the first end 22 of the securing member 20 further includes a releasable attachment mechanism 40 for engaging the anchor member 38, namely the slot 41. The releasable attachment mechanism 40 may be further defined as a T-shaped bar head that can releasably engage the slot 41. Furthermore the securing member 20 has setting markings 42 for adjusting the adjustable back support system 10 to different levels of tension and a stopping mechanism 44. More specifically the stopping mechanism 44 may be further defined as a lug head that can secure the second end 26 of the securing member 20 into releasable locking means 28.

Figure 6:
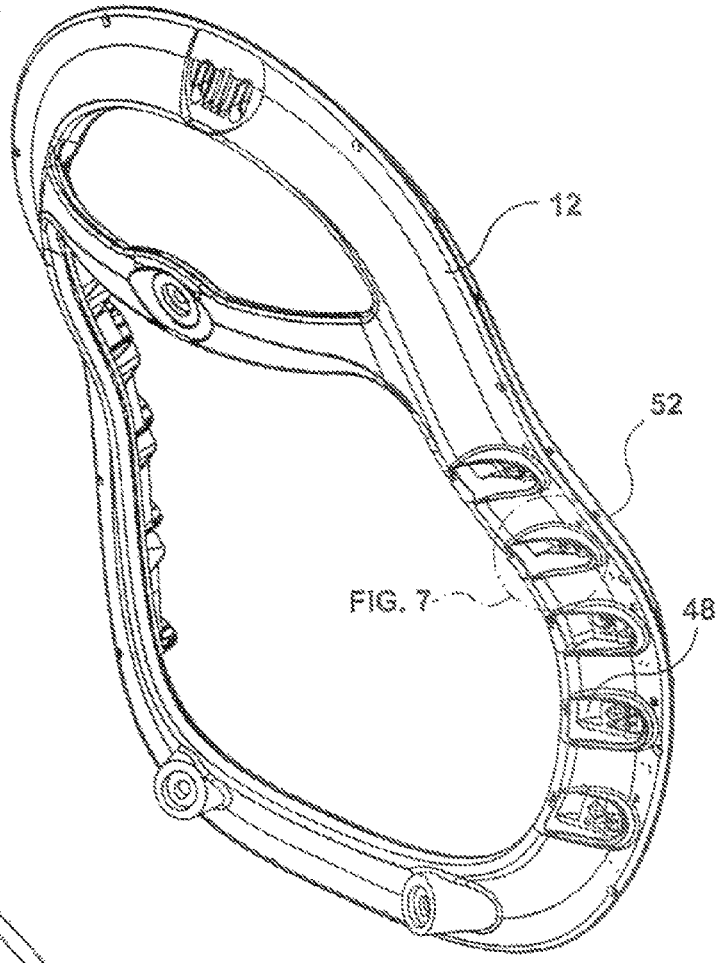
FIG. 6 in a back perspective view illustrates the frame of FIG. 1.
Figure 8:
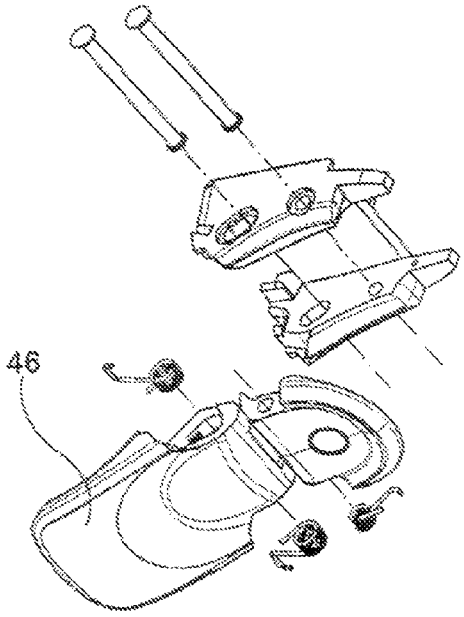
FIG. 8 in an exploded view, illustrates the releasable locking means.
Figure 7:
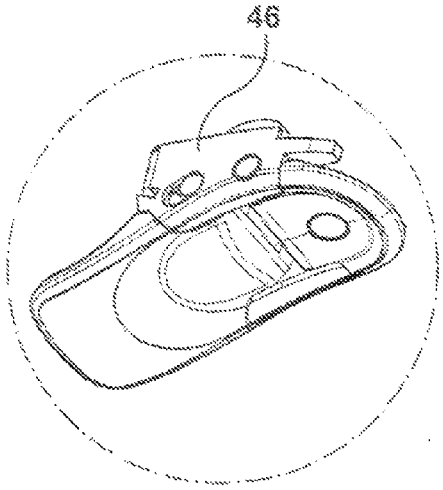
FIG. 7 in a perspective view, illustrates the releasable locking means.

Referring to FIGS. 6 to 8 the releasable locking means 28 is a release-locking mechanism 46 and a series of channels 48 with in the frame 12. The second end 26 is thread through the series of channels 48 so as to engage the release locking means 28. More specifically the release-locking mechanism 46 is adapted to engage the frame 12 and is adapted to receive, engage and release the securing member 20. Finally the tension assembly 18 may be a ratchet assembly or dial-up assembly.

Figure 9:
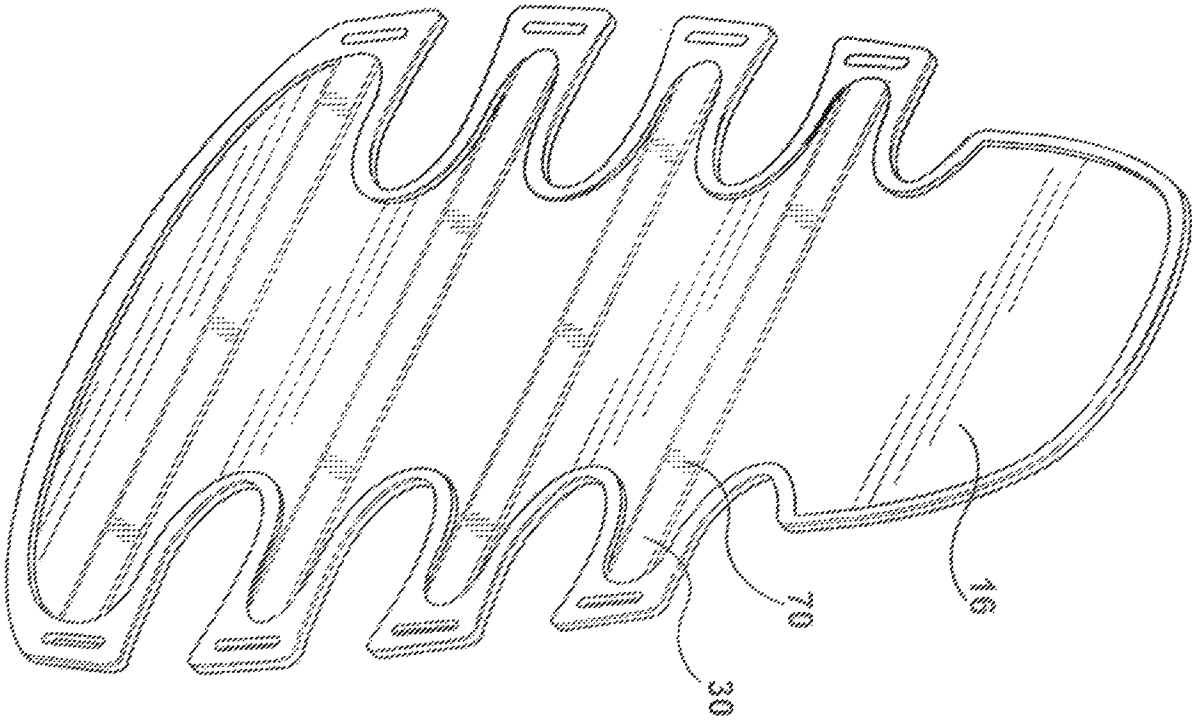
FIG. 9 in a front perspective view illustrates the back support surface of FIG. 1 with integral tensioning zones.
Figure 10:
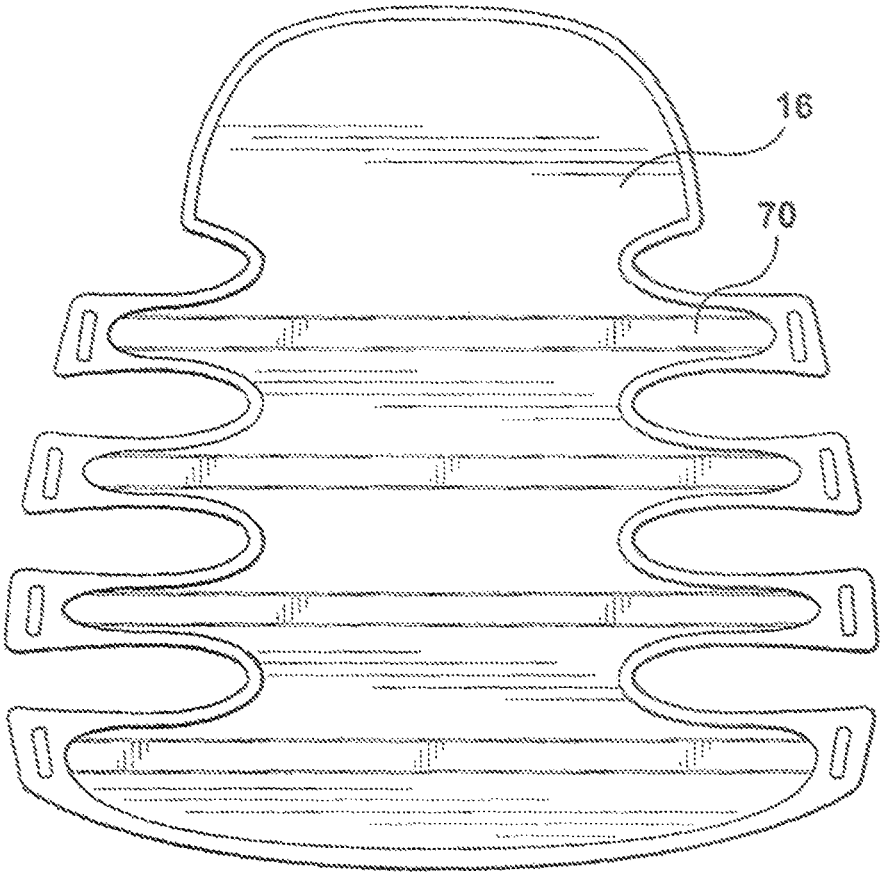
FIG. 10 in a front plan view illustrates the back support surface of FIG. 9.
Figure 10A:
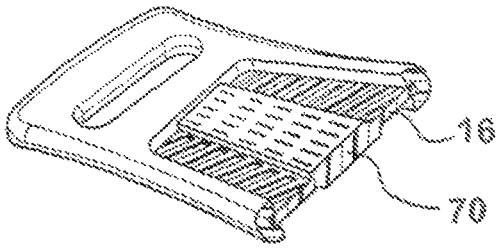
FIG. 10*a* in a cut-away view illustrates the tensioning zones of FIG. 9.

Referring to FIGS. 9 to 10*a* the tensioning member 30 may be a tensioning zone 70 that is integral with the back support surface 16. The tensioning zone 70 can be made from a wide variety of material such as rigid straps, spring members, elastic webbing, polymer based material, fabric and/or plastic members by way of example only. The back support surface 16 may also be made from a variety of substances for example, polymer based material, mesh, plastic or fabric.

Figure 11:
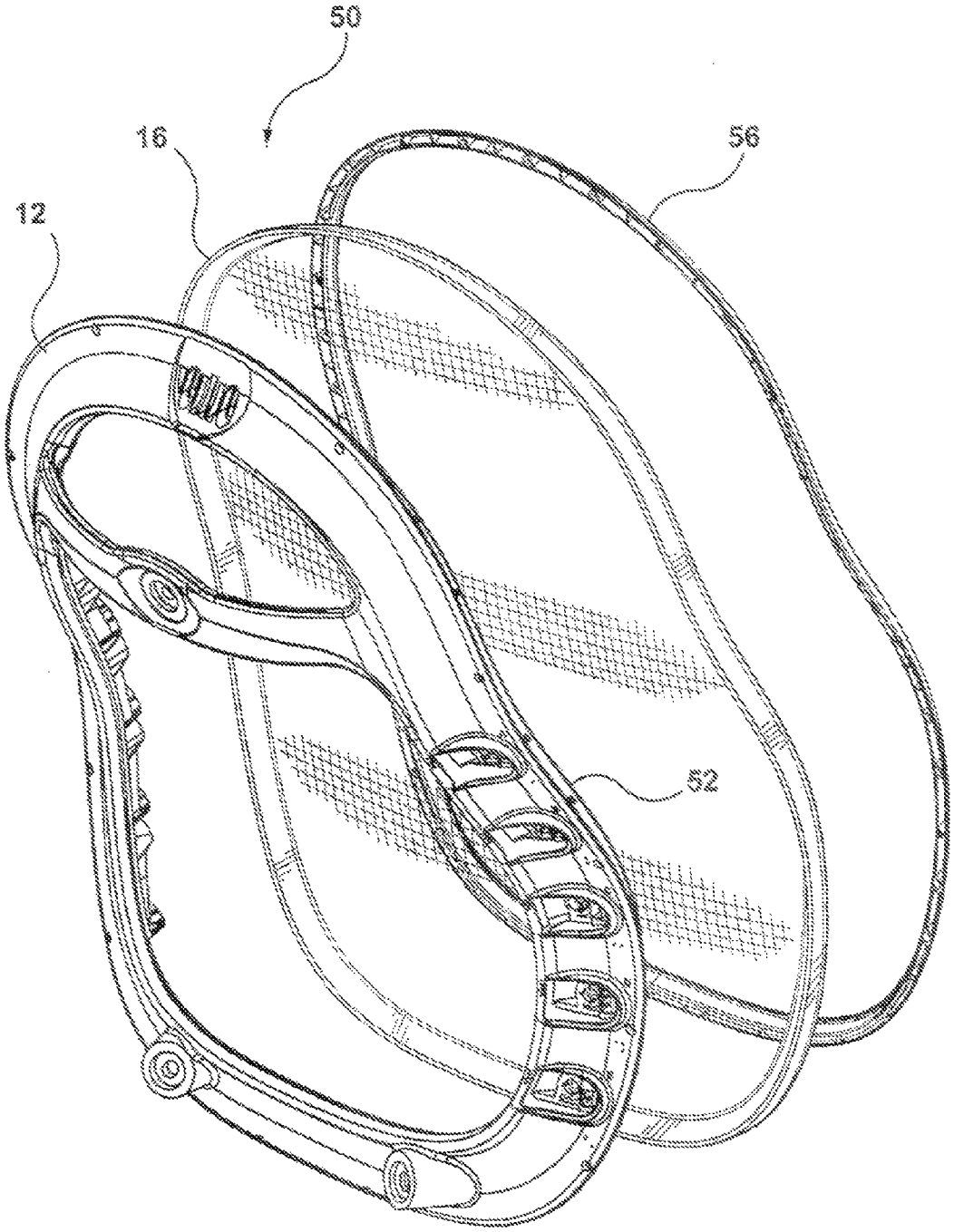
FIG. 11 in an exploded view illustrates the attachment mechanism of the invention described in FIG. 1.
Figure 12:
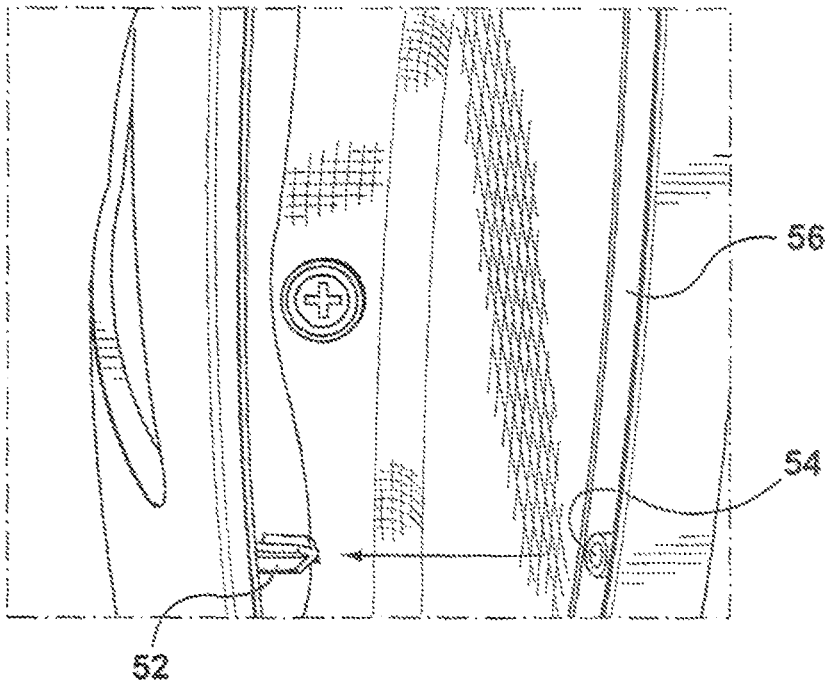
FIG. 12 in a close-up exploded view illustrates the attachment mechanism of FIG. 11.
Figure 12A:
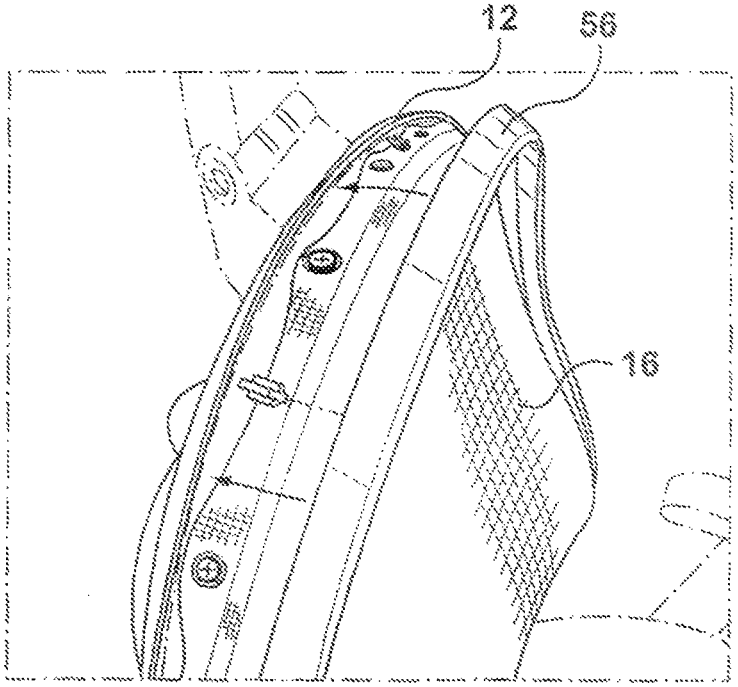
FIG. 12*a* in an exploded view illustrates the attachment mechanism of FIG. 11.
Figure 13:
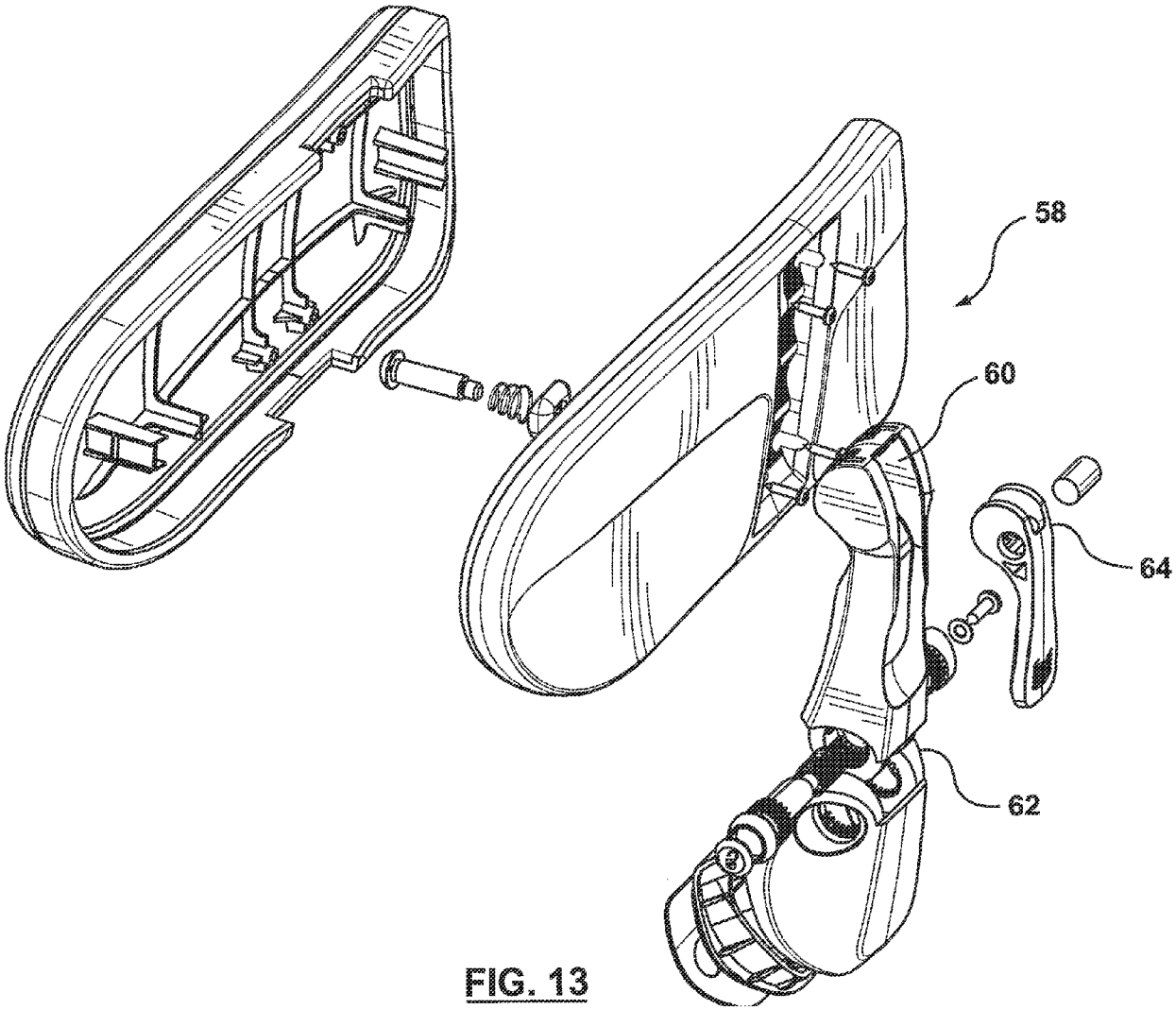
FIG. 13 in an exploded view, illustrates the adjustable head support system of FIG. 1.
Figure 14:
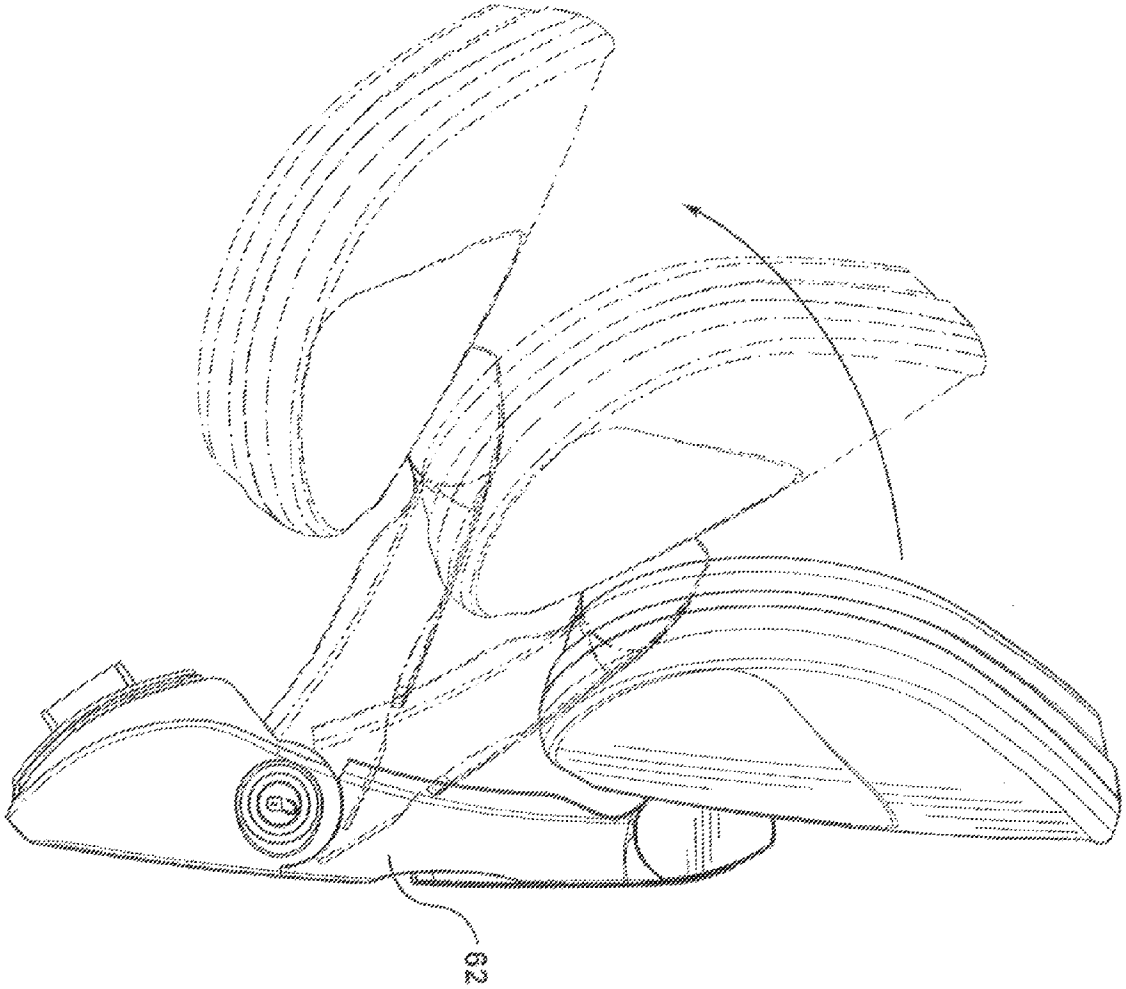
FIG. 14 in a side view illustrates the angle adjustment of the head support system.
Figure 15:
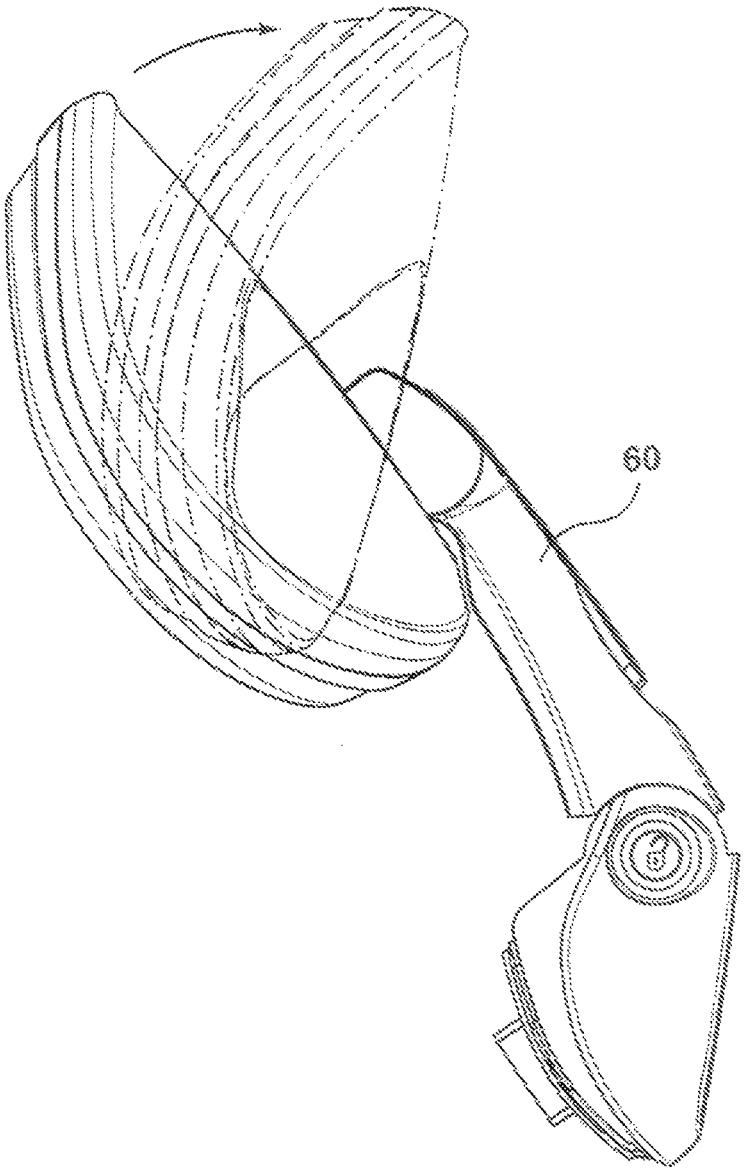
FIG. 15 in a side view illustrates the angle adjustment of the head support system.
Figure 16:
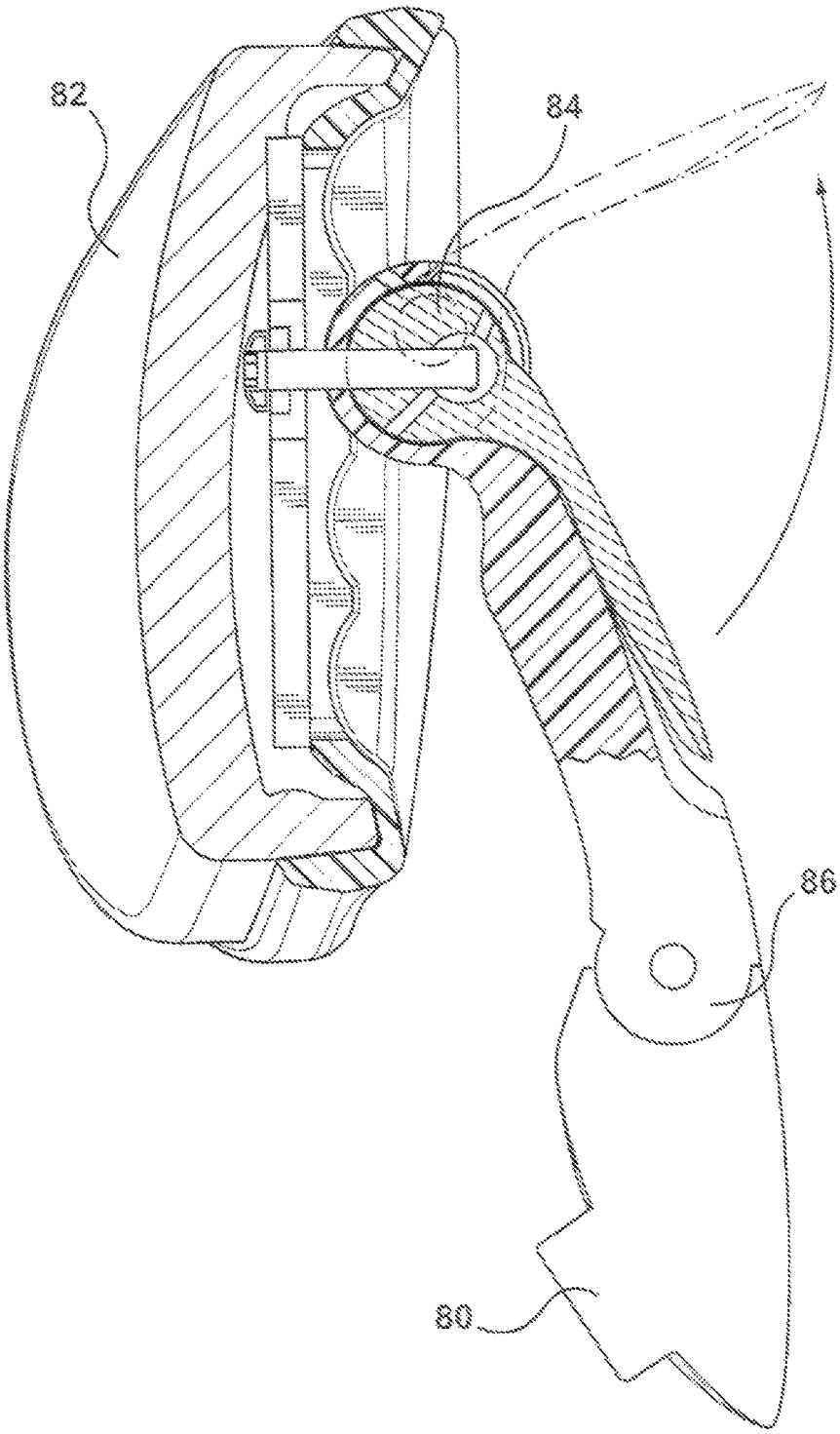
FIG. 16 in a side partial cross-sectional view illustrates the releasable clamping means of the head support system.

Referring to FIGS. 11 and 12*a* typically the back support surface 16 is mounted to the frame 12 by an attachment system 50. The attachment system 50 may further include a series of posts 52 on the frame 12 that are adapted to engage a series of apertures 54 on a reinforcing member 56 whereby the back support surface 16 is positioned in between the frame 12 and the reinforcing member 56. The attachment system 50 may also include securing the back support surface 16 onto the frame 12 by screws or rivets, by way of example only, which are secured into apertures 54 in the frame 12. The screws or rivets may be used in conjunction with glue, contact adhesive or Velcro® positioned on the frame 12 and/or the back support surface 16.

The frame 12 is interchangeable to accommodate alternative shaped frames. The frames 12 may be rigid or flexible and made out of a variety of materials such as nylon, plastic or polymer based material. The flexibility of the frame 12 allows for the dynamic movement. The ability to allow for dynamic movement is important in ergonomic seating, as it allows for the chair seat and back, and seat or chair back to move with the user. The movement can be in an aft and forward movement when viewing the chair from the side. The back of the chair can also actually twist with the user's movement. This can be observed when the user does a twisting action such as reaching back and to the side while seated in a forward position.

Referring to FIGS. 13 to 16, the back support adjustment system may further include a removable, head support system 58 adapted to engage the frame 12. The removable, head support system 58 has a height positioning means 60 and an angle adjusting means 62. Both of the angle adjusting means 62 and the height positioning means 60 are actuated by a releasable clamping means 64. More specifically the head support system 58 further includes a positioning extrusion 80 having a head support 82 at one end. The height positioning means 60 may be further defined as vertical height positioning clamp 84, and the angle adjusting means 62 may be further defined as a biased locking mechanism 86. The vertical positioning clamp 84 can move the head support to at least four different heights as well as allow for the adjustment of the head support 82. The biased locking mechanism 86 also allows for the fore and aft positioning of the head support 82. By way of example the biased locking mechanism may be a push and release spring activated locking mechanism that allows for at least four different positions of the head support 82. The actuation of both the vertical height positioning clamp 84 and the biased locking mechanism 86 is controlled by the releasable clamping means 64 which may be better defined as an over-centre clamp that accomplishes both actions with one component.

Finally the head support system 58 is removable from the frame 12. When not in use a headrest attachment cover 88 conceals the insertion aperture. When the head support system 58 is required, the cover 88 is removed and the positioning extrusion 80 is secured to the inside of the frame 12 by a series of fasteners such as screws.

In operation, when the tensioning assembly 18 is a ratchet assembly arrangement by way of example, the securing member 20 may be a ratchet belt strap that has a first end and a second end. The first end is adapted to engage the tensioning means 24 or elastomeric webbing system that is adjustable to provide various positions of support for the back support surface 16. The second end of the ratchet belt strap can engage the releasable locking means 28 that engages the frame 12. Furthermore the elastomeric webbing system can be described as having a first end and a second end. The first end of the elastomeric webbing system can be attached to a strap fixing buckle that is mounted on one side of the frame 12. The second end of the elastomeric webbing system is mounted the ratchet belt strap by a ratchet belt strap anchor. The ratchet belt strap anchor is adhered to elastomeric webbing system by stitching, glue, screws or rivets. The ratchet belt strap anchor may further include a slot that accepts a T-bar head at one end of the ratchet belt strap. The T-bar head of the ratchet belt strap allows for the convenient installation and removable of the ratchet belt strap. The second end of the ratchet belt strap can include markings and a stopper mechanism. Specifically the ratchet belt strap engages a series of channels on the frame and then engages the release locking mechanism or the ratchet lever system. The stopper mechanism is added to the ratchet belt strap once the ratchet belt strap is fed through the channels, therefore ensuring that the ratchet belt strap stays within the system.

By engaging the ratchet lever system namely pulling on the ratchet lever the ratchet belt strap is pulled closer to the end of the frame thereby increasing the tension on the back support surface 16. The ratchet belt strap therefore can engage various levels of tension and is held in place by the ratchet lever system. When the ratchet lever is released by a ratchet release button, the tension is released or reduced across the back support surface 16. Therefore the ratchet assembly allows for the tensioning across the back support surface 16 from one side of the frame 12 to the other.

Figure 17:
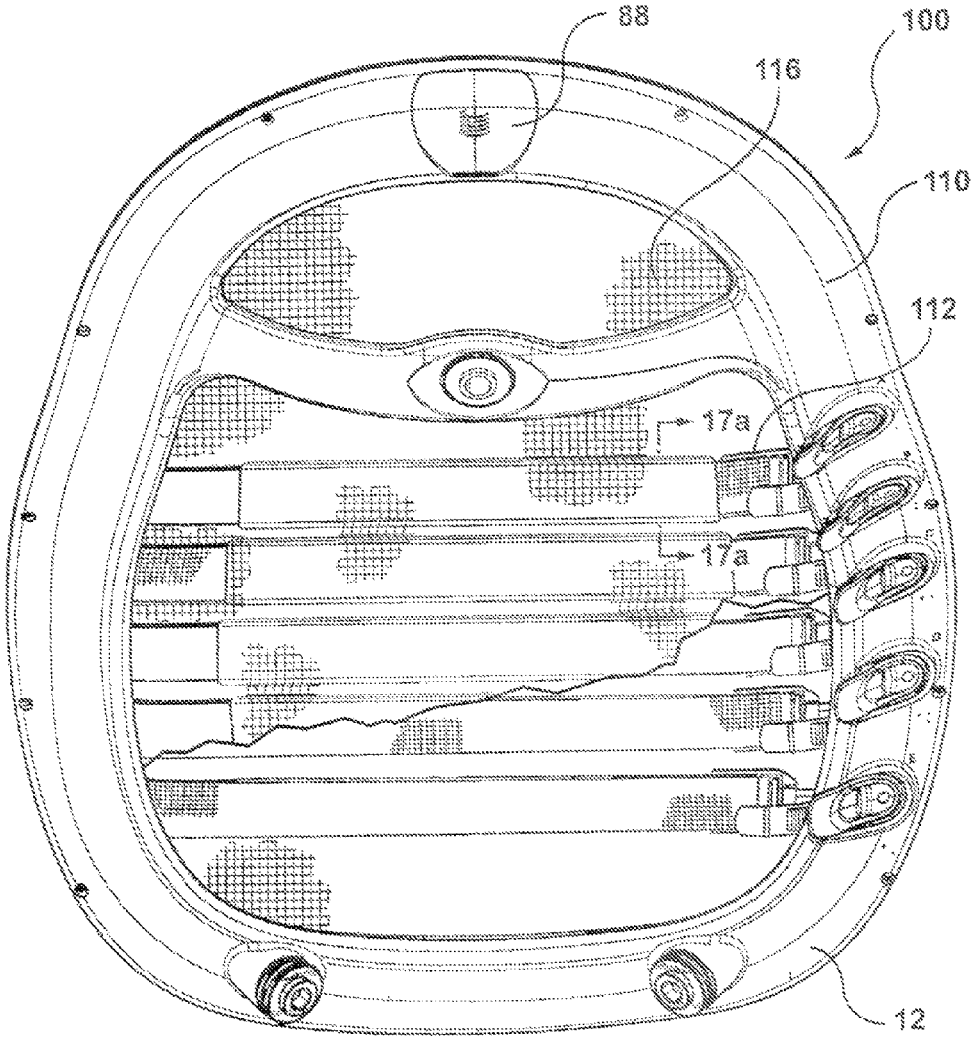
FIG. 17 in a back view illustrates an adjustable back support system having a housing integral with a back support surface.
Figure 17A:
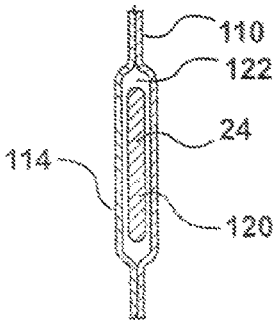
FIG. 17*a* in a cross-sectional view illustrates a tension assembly movable within the housing of FIG. 17.
Figure 18:
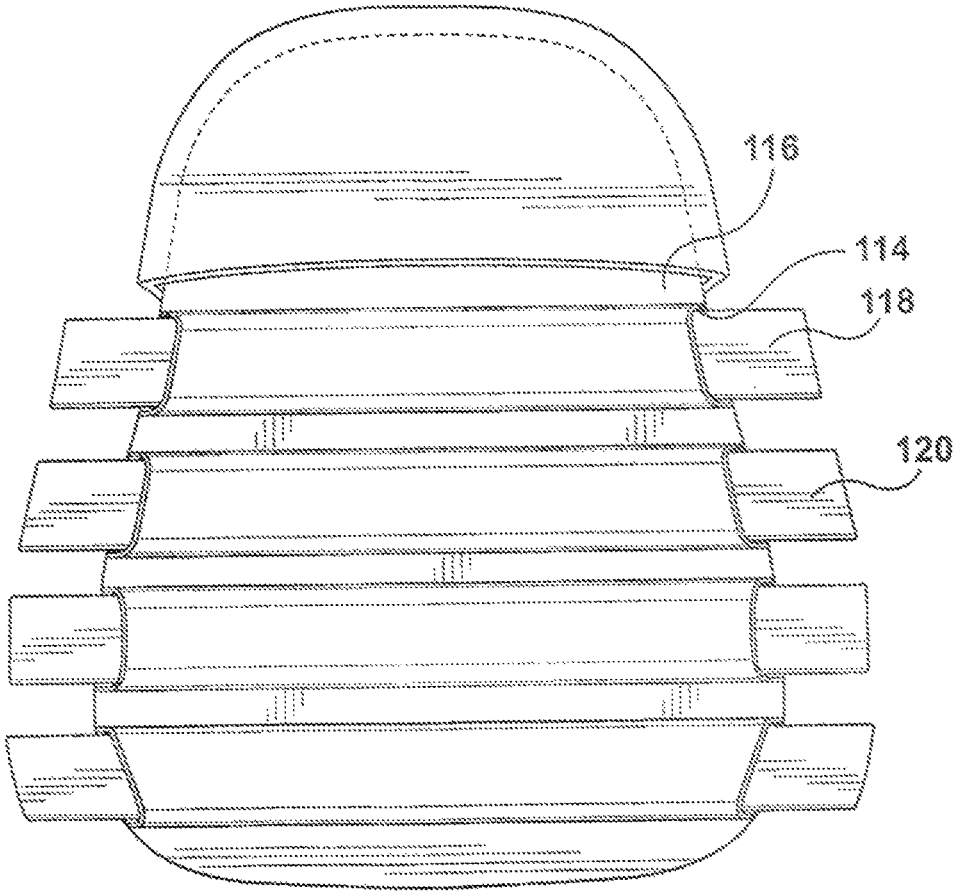
FIG. 18 in a front plan view, illustrates the tension assembly movable with the housing.

Referring to FIGS. 17 to 18 and in accordance with another embodiment of the present invention there is provided a back support adjustment system 100 having a frame 110 and an adjustable back support system 112 that has a housing 114 integral with a back support surface 116 and a tension assembly movable 118 within the housing 114. Both the movable tension assembly 118 and the adjustable back support system 112 are adapted to engage the frame 110 so that the movable tension assembly 118 adjusts the tension of the adjustable back support 116 system through the housing 114.

The movable tensioning assembly 118 is similar to the movable tensioning assembly 18 wherein the movable tensioning assembly 118 is further defined as having a series of tensioning members 120 that can be selected from a group consisting of rigid straps, spring members, elastic webbing or plastic members. More specifically the tensioning members 120 are movable within the housing 114 that is further defined as at least one channel 122 that is integral with the back support surface 116. There could be a series of channels 122 that are integral with back support surface 116. The tensioning members 120 therefore can move within the individual channels 122 as required.

Figure 19:
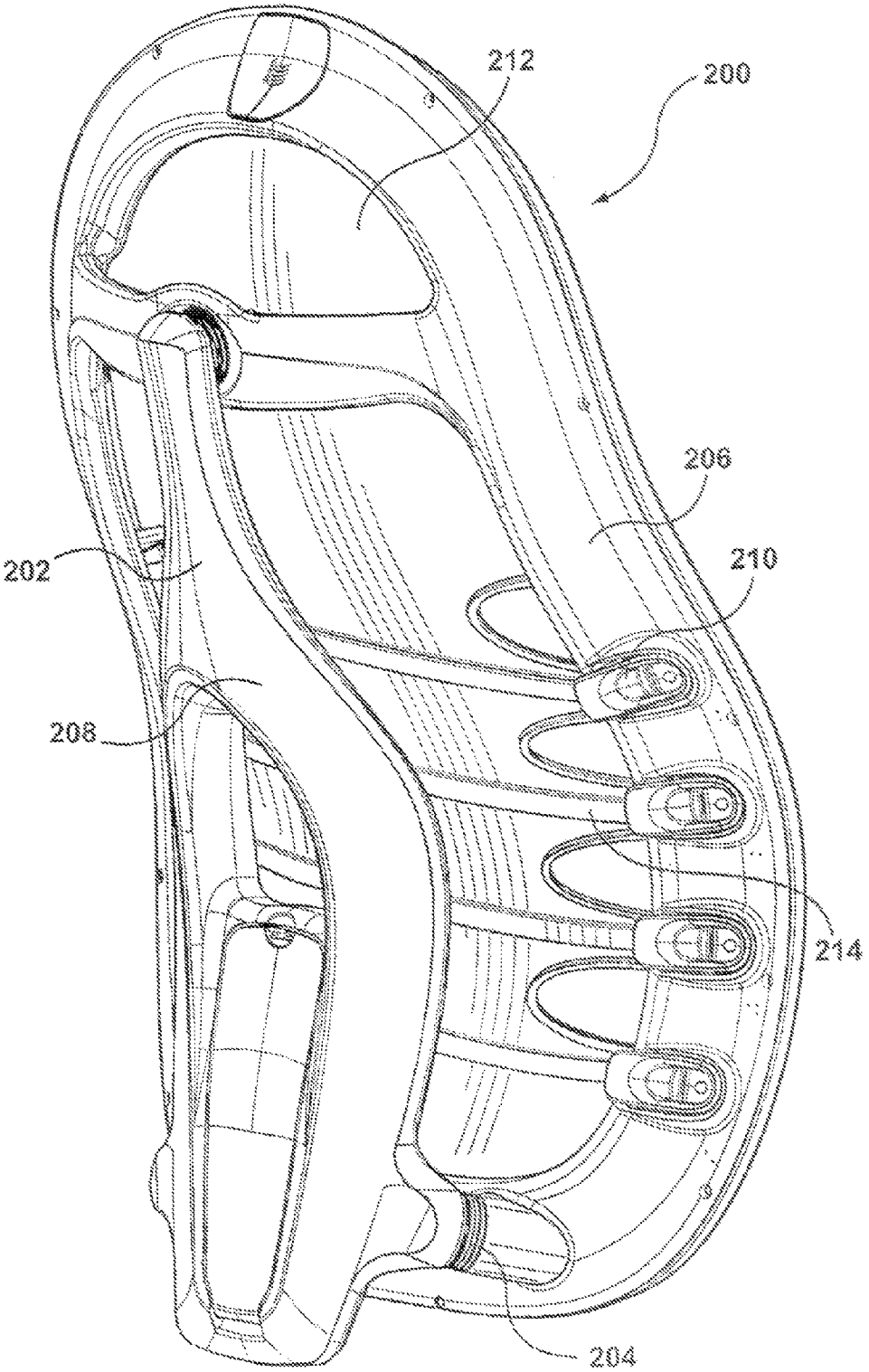
FIG. 19 in a back perspective view illustrates an adjustable back support system having an adjustable tension assembly integral with a back support surface and having a flexible suspension system.
Figure 20:
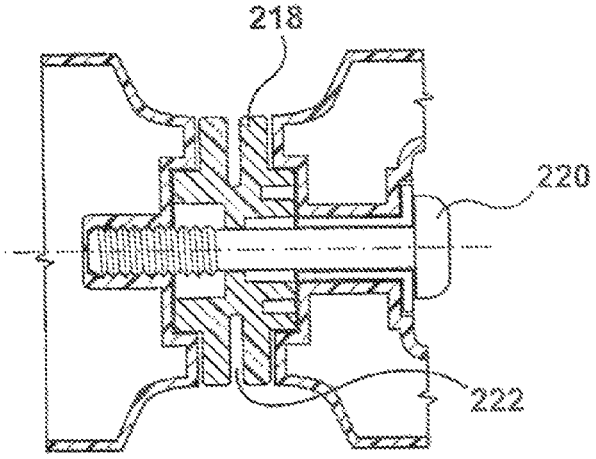
FIG. 20 in a cross-sectional view, illustrates the elastomeric grommets and the adjustable fastening system.
Figure 20A:
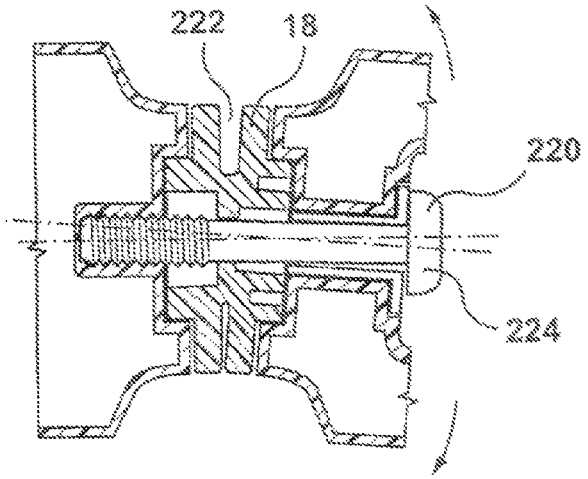
FIG. 20*a* in a cross-sectional view, illustrates the adjusting of the adjustable fastening system.
Figure 20B:
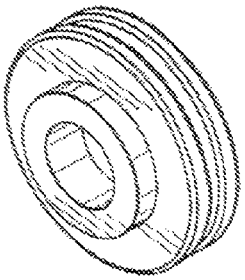
FIGS. 20*b* and 20*c* in perspective views, illustrates the elastomeric grommet.
Figure 20C:
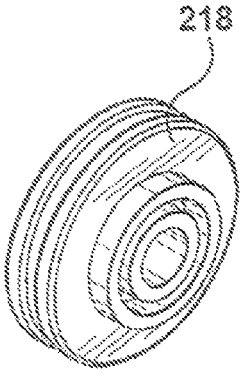

Referring to FIGS. 19 and 20*c*, and in accordance with another aspect of the present invention there is provided a back support adjustment system 200 that includes a flexible suspension system 202 having an adjustable and interchangeable flexing means 204 positioned in between a frame 206 and a support member 208. The back support adjustment system 200 further includes an adjustable back support system 210 having a back support surface 212 and a moveable tension assembly 214 integral within the back support surface 212. Both the back support surface 212 and the movable tension assembly 214 are adapted to engage the frame 206 so that the movable tension assembly 214 adjusts the tension across the back support surface 212 and the adjustable flexing means 204 controls movement of the flexible suspension system 202.

The adjustable flexing means 204 further includes at least two interchangeable and elastomeric grommets 218 that are adapted to receive an adjustable fastening system 220 and are mounted in between the frame 206 and the support member 208. The grommets 218 can have a grooved circumference 220 such that the grooved circumference 220 defines a relief 222. The grommets 218 can have varying degrees of flexibility or durometer.

The adjustable fastening system 220 may be further defined as a single bolt fastening system 224 by way of example only. The grommets 218 allow for increased movement of the structure of the frame 206, therefore providing support to the person using the chair back when their body moves. The movement of the frame 206 takes place as a result of both the durometer of the grommets 218 and the relief area 222. The relief area 222 allows for further movement to take place apart from the improved movement offered by the varied durometer of the grommets 218. By changing the durometer of the grommets 218 and by tightening or loosening the single bolt fastening system 224 that attaches the frame 206 and the support member 208 together, the movement between the support member 208 and the frame 206 can be controlled. The movable tensioning assembly 214 is functions identically to the movable tensioning assembly 18.

Figure 21:
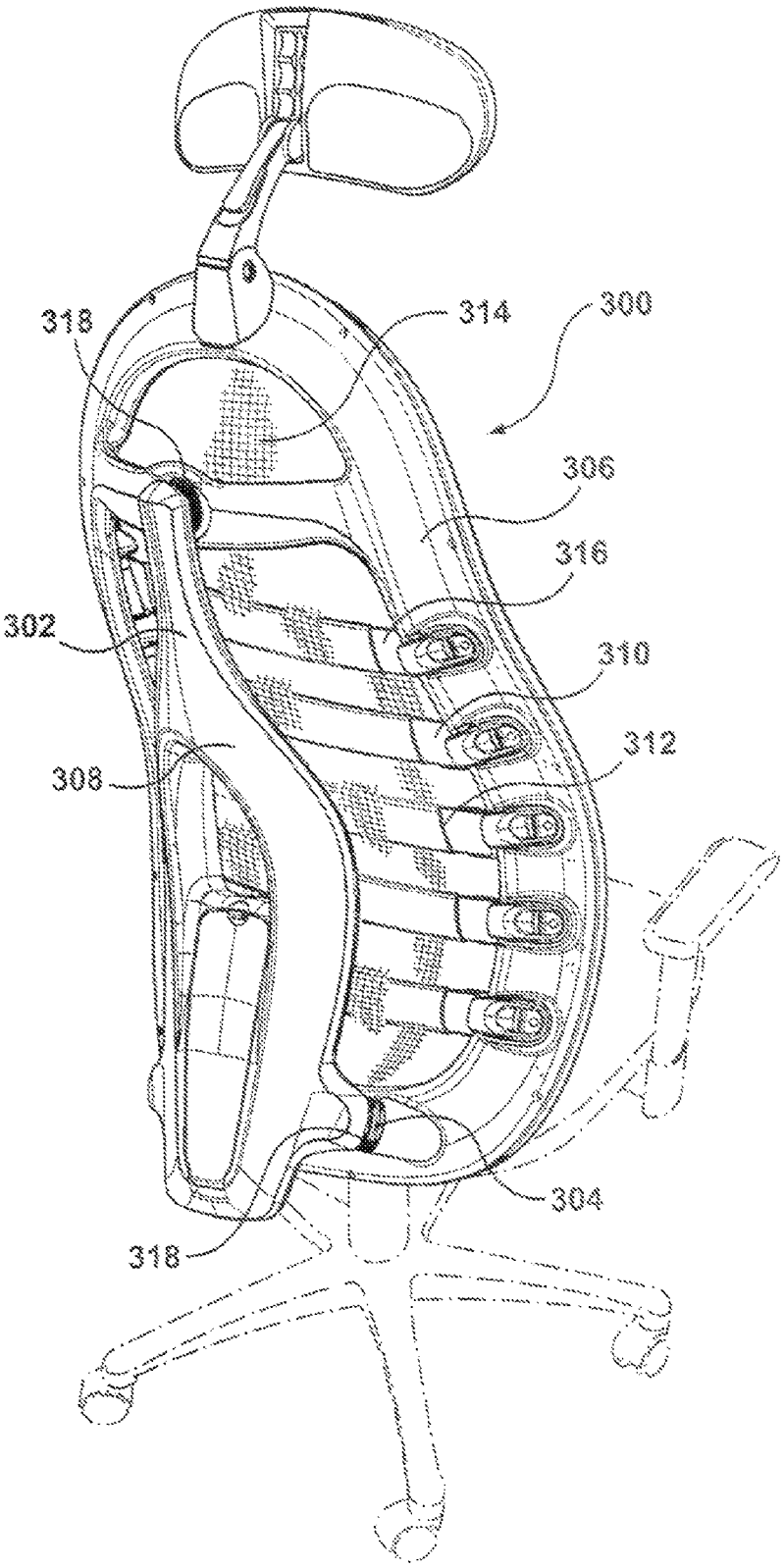
FIG. 21 in back perspective view, illustrates the adjustable back support system of FIG. 19 in a chair environment.
Figure 22:
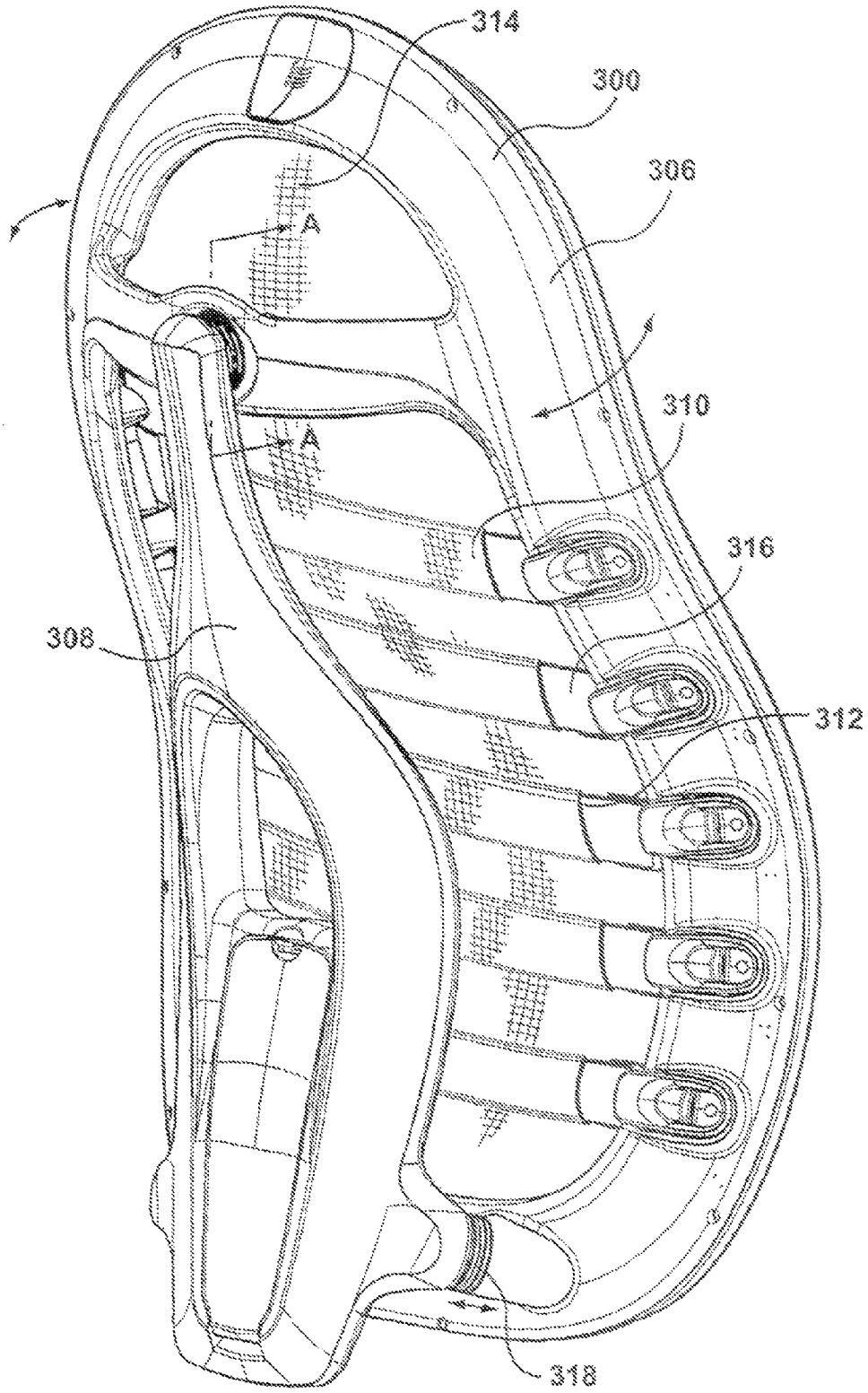
FIG. 22 in a perspective view illustrates an adjustable back support system having an adjustable tension assembly movable within a housing that is integral with a back support surface and having a flexible suspension system.

Referring to FIGS. 21 and 22 there is illustrated a back support adjustment system 300 is described having a flexible suspension system 302 that includes an adjustable and interchangeable flexing means 304 positioned in between a frame 306 and a support member 308. The back support adjustment system 300 further includes an adjustable back support system 310 having a housing 312 integral with a back support surface 314 and a movable tension assembly 316 movable within the housing 312. Both the movable tension assembly 316 and the adjustable back support system 310 are adapted to engage the frame 306 so that the movable tension assembly 316 adjusts the tension of the adjustable back support system 310 and the adjustable flexing means 304 controls movement of the flexible suspension system 302.

As described above the adjustable flexing means 304 further includes at least two interchangeable and elastomeric grommets 316 that are adapted to receive an adjustable fastening system 318 and are mounted in between the frame 306 and the support member 308. The movable tensioning assembly 316 is similar to the movable tensioning assembly 118 described above.

Figure 23:
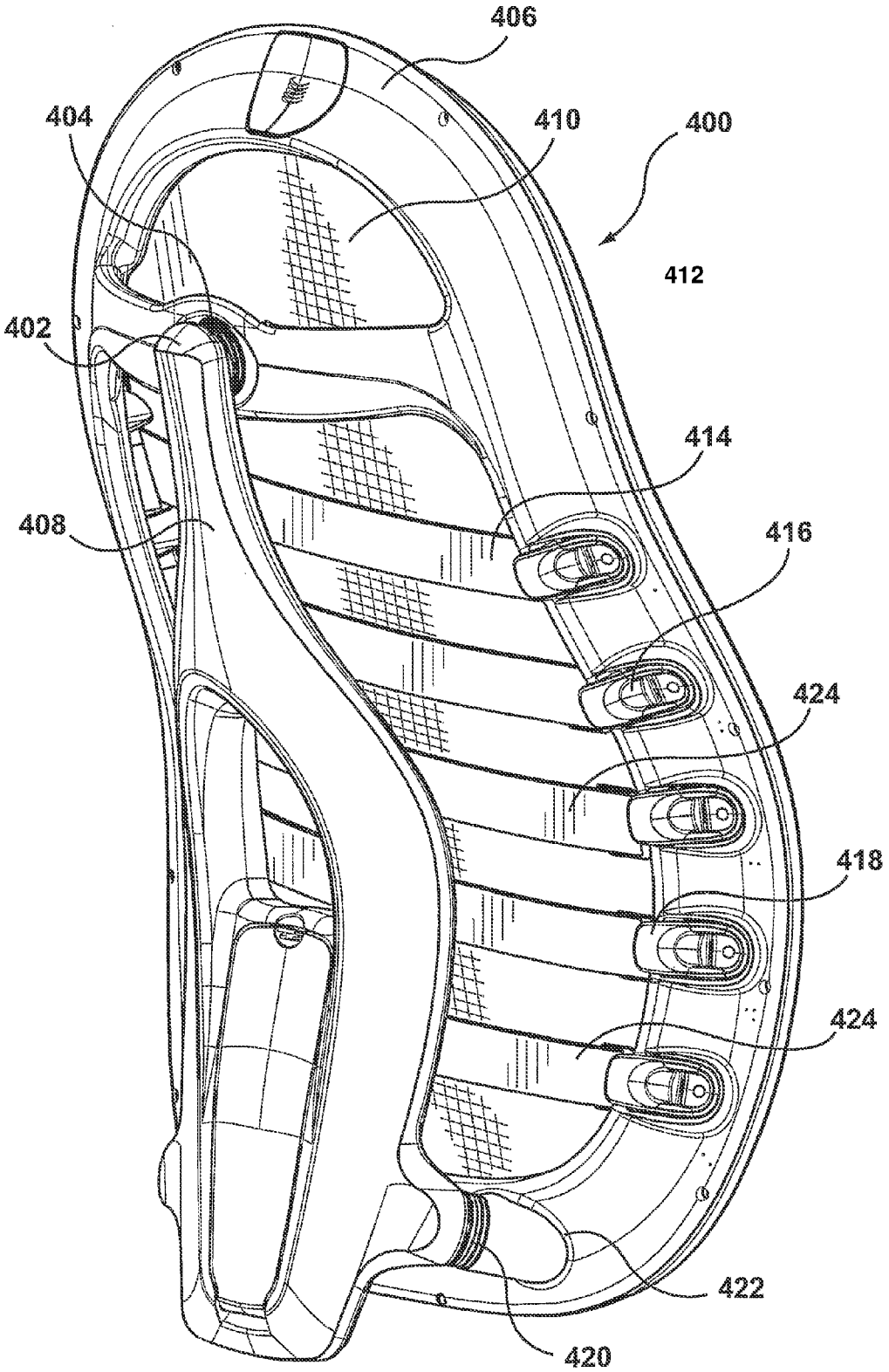
FIG. 23 in a perspective view illustrates an adjustable back support system having an adjustable tension assembly movable adapted to engage a back support surface and having a flexible suspension system.

Another embodiment of the present invention described in FIG. 23, includes a back support adjustment system 400 having a flexible suspension system 402 having an adjustable and interchangeable flexing means 404 positioned in between a frame 406 and a support member 408. The adjustable flexing means 404 controls movement of the flexible suspension system 402. The back support adjustment system 400 also includes a back support surface 410 that is adapted to engage the frame 406 and has a front side 412 and a back side 414. Finally the back support adjustment system 400 includes an adjustable back support system 416 having an adjustable tension assembly 418 mounted to the frame 406 and is adapted to engage the back side 414 of the back support surface 410 when the front side 412 of the back support surface 410 is engaged. As described above the adjustable flexing means 404 further includes at least two interchangeable and elastomeric grommets 420 that are adapted to receive an adjustable fastening system 422 and are mounted in between the frame 406 and the support member 408. The adjustable tensioning assembly 418 is similar to the movable tensioning assembly 118 described above though a housing is not required for the tensioning assembly 418. The tensioning assembly 418 may be defined as a series of tensioning members 424.

Figure 24:
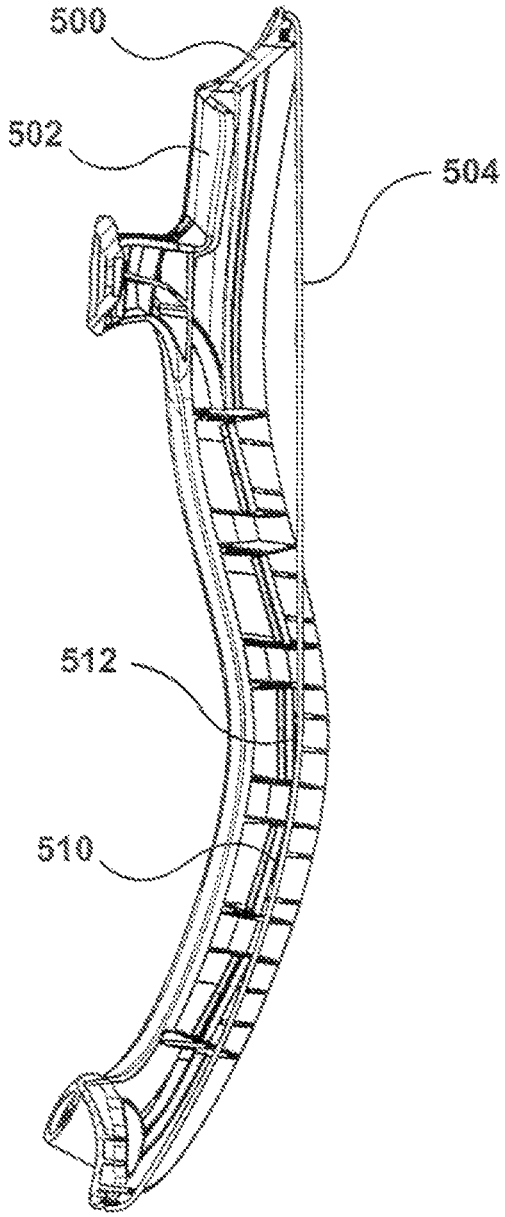
FIG. 24 in a cross sectional view illustrates an adjustable back support system having an adjustable tension assembly movable adapted to engage a back support surface.
Figure 24A:
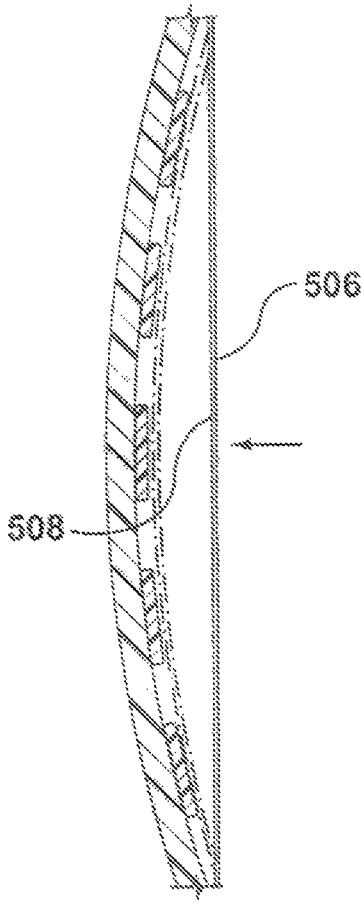
FIG. 24*a* in a cross sectional view illustrates an adjustable tension assembly movable adapted to engage a back support surface FIG. 25 in a back perspective view, illustrates an adjustable back support system having a flexible suspension system.

In FIGS. 24 and 24*a* there is described a back support adjustment system 500 that has a frame 502 and a back support surface 504 adapted to engage the frame 502 where the back support surface 504 having a front side 506 and a back side 508. The back support adjustment system 500 further includes an adjustable back support system 510 having an adjustable tension assembly 512 mounted to the frame 502 and adapted to engage the back side 508 of the back support surface 504 when the front side 506 of the back support surface 504 is engaged. This embodiment is similar to the embodiment described in FIG. 23 but does not include the flexible suspension system 402.

Figure 25:
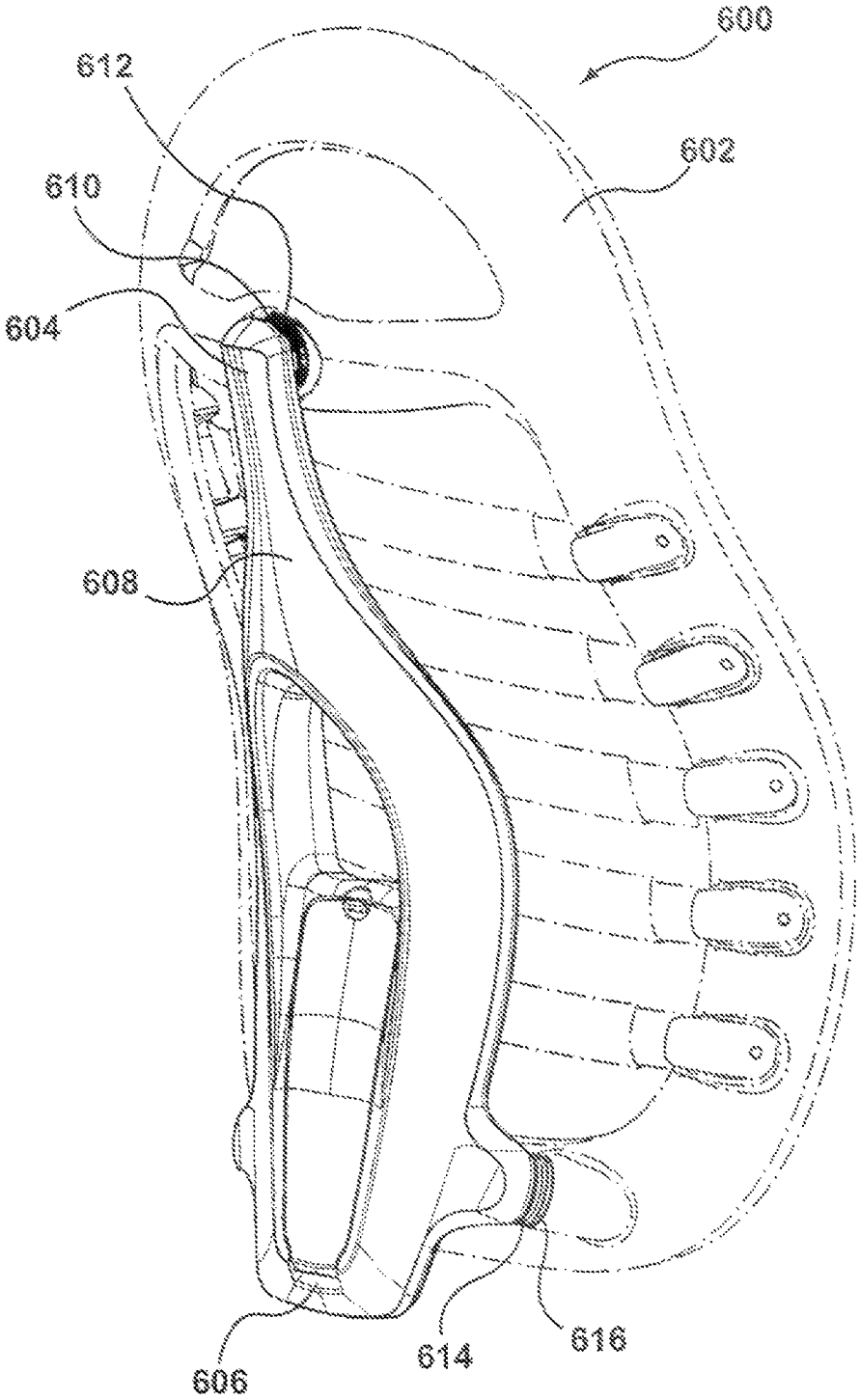
Figure 26:
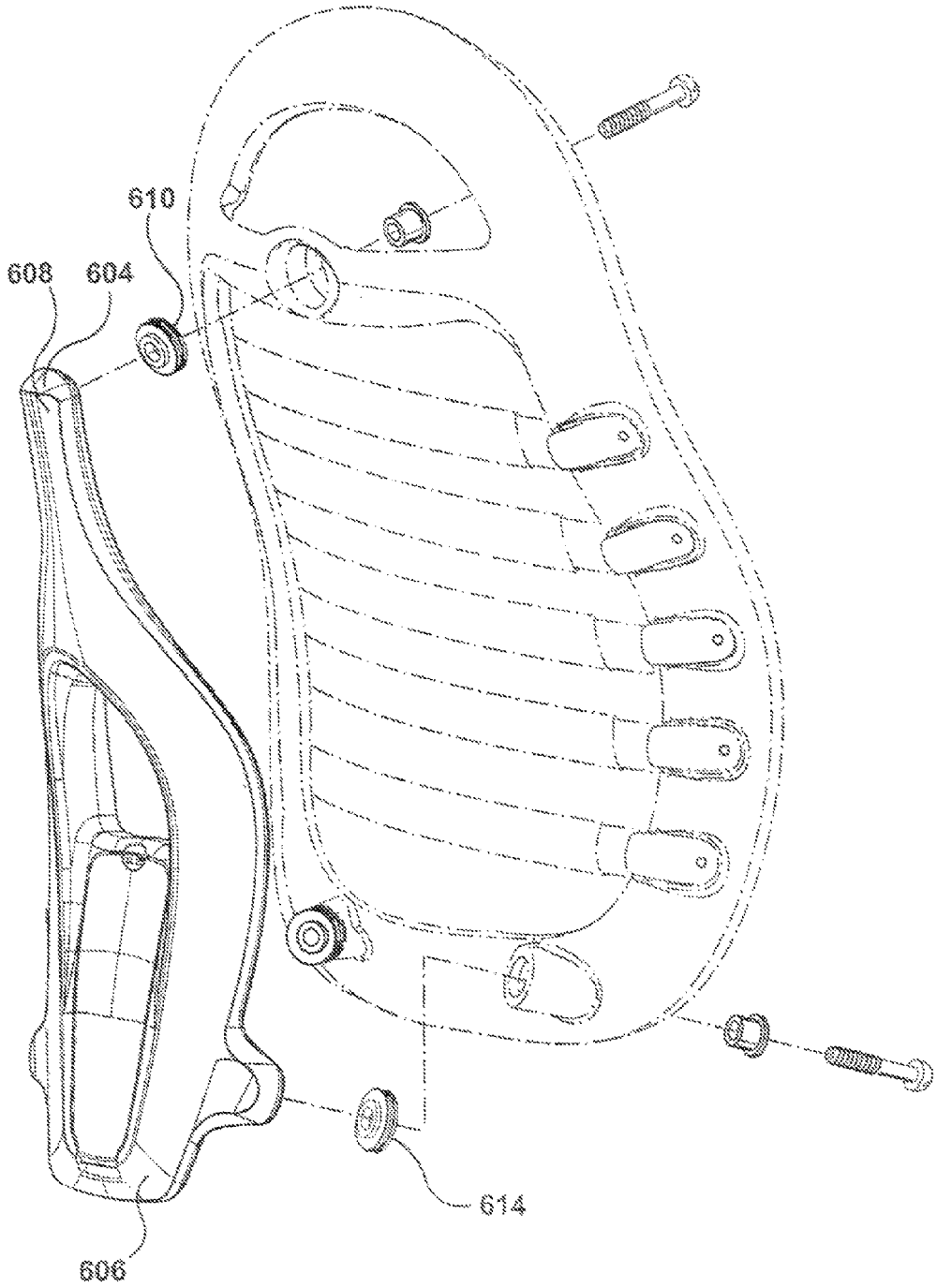
FIG. 26 in an exploded view illustrates the flexible suspension system of FIG. 25.

Referring to FIGS. 25 and 26 there is described another embodiment of the present invention for a back support adjustment system 600 having a frame 602 having a top portion 604 and a bottom portion 606, a support member 608, and a first adjustable and interchangeable flexing means 610 positioned in between the frame 602 and the support member 608 at the top portion 604 of the frame 602 thereby defining a single pivot point 612. At least a second adjustable and interchangeable flexing means 614 may be positioned in between the frame 602 and the support member 608 at the bottom portion 606 of the frame 602 thereby defining at least single positioning point 616. The support member 608 may further include a compartment having a flip-out, detachable information door that conceals the compartment. The compartment allows for the operational instructions to be located on the inside of the frame 12 and can even accommodate an informational CD.

FIGS. 13 to 16 describe another embodiment of the present invention that provides for a removable head support system 58 for seating, as described above, having a height positioning means 60 and an angle adjustment means 62 so that the height positioning means 60 and the angle adjustment means 62 are controlled by a releasable clamping means 64, which is engaged when moving the height positioning means 60 up and down, and engaged when moving the angle adjustment means 62 between a fore and aft position. More specifically the head support system 58 further includes a positioning extrusion 80 that includes an arm 81 and also includes a head support 82 located at one end of the arm 81.

The height positioning means 60 may be further defined as vertical height positioning clamp 84, and the angle adjusting means 62 may be further defined as a biased locking mechanism 86. The vertical positioning clamp 84 can move the head support to at least four different heights as well as allow for the adjustment of the head support 82. The biased locking mechanism 86 also allows for the fore and aft positioning of the head support 82. By way of example the biased locking mechanism may be a push and release spring activated locking mechanism that allows for at least four different positions of the head support 82. The actuation of both the vertical height positioning clamp 84 and the biased locking mechanism 86 is controlled by the releasable clamping means 64 which may be better defined as an over-centre clamp that accomplishes both actions with one component.

Finally the head support system 58 is removable from the frame 12. When not in use a headrest attachment cover 88 conceals the insertion aperture. When the head support system 58 is required, the cover 88 is removed and the positioning extrusion 80 is secured to the inside of the frame 12 by a series of fasteners such as screws.

Other variations and modifications of the invention are possible. All such modifications or variations are believed to be within the sphere and scope of the invention as defined by the claims appended hereto.

I claim:

1. A back support adjustment system comprising:

(a) a flexible suspension system having an adjustable and interchangeable flexing means positioned in between a frame and a support member; and (b) an adjustable back support system having a back support surface and a moveable tension assembly integral within the support surface, both the support surface and the movable tension assembly adapted to engage the frame, whereby the movable tension assembly adjusts the tension across the support surface and the adjustable flexing means controls movement of the flexible suspension system.

2. A back support adjustment system as claimed in claim 1 wherein the frame is interchangeable with alternative shaped frames.

3. A back support adjustment system as claimed in claim 1 wherein the support surface is polymer based material, mesh, plastic or fabric.

4. A back support adjustment system as claimed in claim 1 wherein the support surface is mounted to the frame by an attachment system.

5. A back support adjustment system as claimed in claim 4 wherein the attachment system further comprises a series of posts on the frame that are adapted to engage a series of apertures on a reinforcing member whereby a housing is positioned in between the frame and the reinforcing member.

6. A back support adjustment system as claimed in claim 1 wherein the adjustable flexing means further comprises at least two interchangeable and elastomeric grommets adapted to receive an adjustable fastening system and mounted in between the frame and the support member.

7. A back support adjustment system as claimed in claim 6 wherein the grommets have a grooved circumference, the grooved circumference defining a relief.

8. A back support adjustment system as claimed in claim 7 wherein the grommets have varying flexibility.

9. A back support adjustment system as claimed in claim 1 further comprising a removable, head support system adapted to engage the frame.

10. A back support adjustment system as claimed in claim 9 wherein the removable, head support system has a height positioning means and an angle adjusting means.

11. A back support adjustment system as claimed in claim 10 wherein the angle adjusting means and the height positioning means is actuated by a releasable clamping means.

12. A back support adjustment system as claimed in claim 11 wherein the height positioning means is further defined as a height positioning clamp and the angle adjusting means is a biased locking mechanism.

13. A back support adjustment system as claimed in claim 1 wherein the tension assembly further comprises a series of securing members, each having a first end adapted to engage a tensioning means, and a second end adapted to engage a releasable locking means mounted in the frame.

14. A back support adjustment system as claimed in claim 13 wherein the tension assembly is a ratchet assembly or dial-up assembly.

15. A back support adjustment system as claimed in claim 13 wherein the tensioning means is a series of tensioning members, each having a first end adapted to engage a fixing buckle mounted in the frame, and a second end having an anchor member adapted to engage the first end of the securing member.

16. A back support adjustment system as claimed in claim 15 wherein the tensioning member is a tensioning zone integral with the back support surface.

17. A back support adjustment system as claimed in claim 16 wherein the tensioning zone is selected from a group consisting of rigid straps, spring members, elastic webbing, polymer based material, fabric and plastic members.

18. A back support adjustment system as claimed in claim 15 wherein the first end of the securing member further comprises a releasable attachment mechanism for engaging the anchor member.

19. A back support adjustment system as claimed in claim 18 wherein the securing member has a setting marking for adjusting the hack support adjustment system to different levels of tension and a stopping mechanism.

20. A back support adjustment system as claimed in claim 19 wherein the releasable locking means is a release-locking mechanism and series of channels adapted to receive the securing, member and engage and release the securing mechanism.

21. A back support adjustment system comprising:

(a) a flexible suspension system having an adjustable and interchangeable flexing means positioned in between a frame and a support member; and (b) an adjustable back support system having a housing integral with a back support surface and a tension assembly movable within the housing, both the tension assembly and the adjustable back support system adapted to engage the frame, whereby the movable tension assembly adjusts the tension of the adjustable back support system and the adjustable flexing, means controls movement of the flexible suspension system.

22. A back support adjustment system as claimed in claim 21 wherein the frame is interchangeable with alternative shaped frames.

23. A back support adjustment system as claimed in claim 21 wherein the support surface is polymer based material, mesh, plastic or fabric.

24. A back support adjustment system as claimed in claim 21 wherein the support surface is mounted to the frame by an attachment system.

25. A back support adjustment system as claimed in claim 24 wherein the attachment system further comprises a series of posts on the frame that are adapted to engage a series of apertures on a reinforcing member whereby the housing is positioned in between the frame and the reinforcing member.

26. A back support adjustment system as claimed in claim 21 wherein the adjustable flexing means further comprises at least two interchangeable and elastomeric grommets adapted to receive an adjustable fastening system and mounted in between the frame and the support member.

27. A back support adjustment system as claimed in chum 26 wherein the grommets have a grooved circumference, the grooved circumference defining a relief.

28. A back support adjustment system as claimed in claim 27 wherein the grommets have varying flexibility.

29. A back support adjustment system as claimed in claim 21 further comprising a removable, head support system adapted to engage the frame.

30. A back support adjustment system as claimed in claim 29 wherein the removable, head support system has a height positioning means and an angle adjusting means.

31. A back support adjustment system as claimed in claim 30 wherein the angle adjusting means and the height positioning means is actuated by a releasable clamping means.

32. A back support adjustment system as claimed in claim 31 wherein the height positioning means is further defined as a height position clamp and the angle adjusting means is a biased locking mechanism.

33. A back support adjustment system as claimed in claim 21 wherein the tension assembly further comprises a series of securing members, each having a first end adapted to engage a tensioning means, and a second end adapted to engage a releasable locking means mounted in the frame.

34. A hack support adjustment system as claimed in claim 33 wherein the tension assembly is a ratchet assembly or dial-up assembly.

35. A back support adjustment system as claimed in claim 33 wherein the tensioning means is a series of tensioning members, each having a first can adapted to engage a fixing buckle mounted in the frame, and a second end having an anchor member adapted to engage the first end of the securing member.

36. A back support adjustment system as claimed in claim 35 wherein the tensioning member is selected from a group consisting of rigid straps, spring members, elastic webbing, and plastic members.

37. A back support adjustment system as claimed in claim 35 wherein the housing further comprises a series of integral channels adapted to accept the series of tensioning members.

38. A back support adjustment system as claimed in claim 35 wherein the first end of the securing member further comprises a releasable attachment mechanism for engaging the anchor member.

39. A back support adjustment system as claimed in claim 38 wherein the securing member has a setting marking for adjusting the back support adjustment system to different levels of tension and a stopping mechanism.

40. A back support adjustment system as claimed in claim 39 wherein the releasable locking means is a release-locking mechanism and a series of channels adapted to receive the securing member and engage and release the securing mechanism.

41. A hack support adjustment system comprising:

(a) a flexible suspension system laving an adjustable and interchangeable flexing means positioned in between a frame and a support member, the adjustable flexing means controls movement of the flexible suspension system; and (b) a back support surface adapted to engage the frame, the back support surface having a front side and a back side; and (c) an adjustable back supports system having an adjustable tension assembly mounted to the frame and adapted to engage the back side of the back support surface when the front side of the back support surface is engaged.

42. A back support adjustment system as claimed in claim 41 wherein the frame is interchangeable with alternative shaped frames.

43. A hack support adjustment system as claimed in claim 41 wherein the back support surface is polymer based material, mesh, plastic or fabric.

44. A back support adjustment system as claimed in claim 41 wherein the support surface is mounted to the frame by an attachment system.

45. A back support adjustment system as claimed in claim 44 wherein the attachment system further comprises a series of posts on the frame that are adapted to engage a series of apertures on a reinforcing member whereby the housing is positioned in between the frame and the reinforcing member.

46. A back support adjustment system as claimed in claim 41 wherein the adjustable flexing means further comprises at least two interchangeable and elastomeric grommets adapted to receive an adjustable fastening system and mounted in between the frame and the support member.

47. A back support adjustment system as claimed in claim 46 wherein the grommets have a grooved circumference, the grooved circumference defining a relief.

48. A back support adjustment system as claimed in claim 47 wherein the grommets have varying flexibility.

49. A back support adjustment system as claimed in claim 41 further comprising a removable, head support system adapted to engage the frame.

50. A back support adjustment system as claimed in claim 49 wherein the removable, head support system has a height positioning means and an angle adjusting means.

51. A back support adjustment system as claimed in claim 50 wherein the angle adjusting means and the height positioning means is actuated by a releasable clamping means.

52. A back support adjustment system as claimed in claim 51 wherein the height positioning means is further defined as a height positioning clamp and the angle adjusting means is a biased locking mechanism.

53. A back support adjustment system as claimed in claim 41 wherein the tension assembly further comprises a series of securing members, each having a first end adapted to engage as tensioning means, and a second end adapted to engage a releasable locking means mounted in the frame.

54. A back support adjustment system as claimed in claim 53 wherein the tension assembly is a ratchet assembly or dial-up assembly.

55. A back support adjustment system as claimed in claim 53 wherein the tensioning means is a series of tensioning members, each having a first end adapted to engage a fixing buckle mounted in the frame, and it second end having an anchor member adapted to engage the first end of the securing member.

56. A back support adjustment system as claimed in claim 55 wherein the tensioning member is selected from a group consisting of rigid straps, spring members, elastic webbing, and plastic members.

57. A back support adjustment system as claimed in claim 55 wherein the first end of the securing member further comprises a releasable attachment mechanism for engaging the anchor member.

58. A back support adjustment system as claimed in claim 57 wherein the securing member has a setting marking for adjusting the back support adjustment system to different levels of tension and a stopping mechanism.

59. A back support adjustment system as claimed in claim 58 wherein the releasable locking means is a release-locking mechanism and series of channels adapted to receive the securing member and engage and release the securing mechanism.

* * * * *